US006644683B1

(12) United States Patent
Hauglin et al.

(10) Patent No.: US 6,644,683 B1
(45) Date of Patent: Nov. 11, 2003

(54) SKI BINDING, ESPECIALLY FOR CROSS-COUNTRY SKIS

(75) Inventors: Bernt-Otto Hauglin, Royken (NO); Alain Stump, Villars (CH)

(73) Assignee: Rottefella AS (NO)

( * ) Notice: Subject to any disclaimer, the term of this patent is extended or adjusted under 35 U.S.C. 154(b) by 0 days.

(21) Appl. No.: 09/744,361

(22) PCT Filed: Jul. 21, 1999

(86) PCT No.: PCT/IB99/01306

§ 371 (c)(1),
(2), (4) Date: Mar. 30, 2001

(87) PCT Pub. No.: WO00/04965

PCT Pub. Date: Feb. 3, 2000

(30) Foreign Application Priority Data

| | | |
|---|---|---|
| Jul. 22, 1998 | (DE) | 198 33 042 |
| Jul. 22, 1998 | (DE) | 198 33 041 |
| Sep. 28, 1998 | (DE) | 198 44 475 |
| Dec. 4, 1998 | (DE) | 198 56 143 |

(51) Int. Cl.[7] ..... A63C 9/00
(52) U.S. Cl. ..... 280/613; 280/614
(58) Field of Search ..... 280/624, 611, 280/614, 613, 615, 623, 625, 626, 634, 633

(56) References Cited

U.S. PATENT DOCUMENTS

| | | | | | |
|---|---|---|---|---|---|
| 1,372,752 | A | * | 3/1921 | Holmes | 280/614 |
| 3,984,124 | A | * | 10/1976 | Gertsch | |
| 4,239,254 | A | * | 12/1980 | Riedel | 280/605 |
| 4,273,355 | A | * | 6/1981 | Storandt | 280/614 |
| 4,732,405 | A | * | 3/1988 | Freisinger et al. | |
| 4,932,678 | A | | 6/1990 | Makarenko | 280/615 |
| 4,948,158 | A | | 8/1990 | Makarenko | 280/615 |
| 5,066,036 | A | * | 11/1991 | Broughton | 280/615 |
| 5,228,714 | A | * | 7/1993 | Dekanovsky | 280/615 |
| 5,249,820 | A | * | 10/1993 | Burger et al. | 280/614 |
| 5,664,797 | A | | 9/1997 | Haughlin | 280/615 |
| 5,671,941 | A | * | 9/1997 | Girard | |
| 5,924,719 | A | * | 7/1999 | Girard | |
| 5,941,553 | A | * | 8/1999 | Korman | |
| 5,944,337 | A | * | 8/1999 | Girard et al. | |
| 6,017,050 | A | * | 1/2000 | Girard | |
| 6,099,018 | A | | 8/2000 | Maravetz et al. | 280/624 |
| 6,120,038 | A | | 9/2000 | Dong et al. | 280/7.13 |

FOREIGN PATENT DOCUMENTS

| | | | |
|---|---|---|---|
| DE | 33 06 618 A1 | | 8/1984 |
| DE | 37 07 116 A1 | | 9/1987 |
| DE | 40 07 667 C1 | | 6/1991 |
| DE | 195 22 343 A1 | | 12/1996 |
| DE | 196 01 545 A1 | | 7/1997 |
| EP | 0 679 416 A1 | | 4/1995 |
| NO | WO 96/39233 | * | 12/1996 |
| WO | WO 94/27692 | | 12/1994 |

* cited by examiner

*Primary Examiner*—Paul N. Dickson
*Assistant Examiner*—Laura B. Rosenberg
(74) *Attorney, Agent, or Firm*—Knobbe Martens Olson & Bear, LLP

(57) ABSTRACT

A ski binding for cross-country ski fixes the front section of a boot such that the heel of the boot can be freely lifted off. The boot is fixed to the binding by an interlocking engagement of its sole, and by holding down the front end of the sole. Elements are also provided that laterally guide and stabilize the sole and, hence, the boot.

11 Claims, 17 Drawing Sheets

SKI BINDING, ESPECIALLY FOR CROSS-COUNTRY SKIS

BACKGROUND OF THE INVENTION

1. Field of the Invention

The invention relates to a binding, especially for cross-country skis, for fixing a front section of a boot in such a way that during use the heel of the boot can be freely lifted off.

2. Description of the Related Art

Such bindings are generally known for skis intended for cross-country or touring use or for telemark sport. A binding designed for this purpose should be both simple in construction and reliable in function, during both cross-country and downhill skiing. Furthermore, a binding for touring or cross-country skiing should be ergonomically advantageous, enabling anatomically appropriate locomotor movements on skis.

SUMMARY OF THE INVENTION

This aim is attained with a ski binding of the kind mentioned above in that the boot becomes fixed to the binding firstly by a hooking or interlocking engagement of the sole of the boot, in the region between the ball and the front end and in particular in the toe-joint region of the sole, and secondly by means of a device that acts on the sole or on the boot, in particular in an elastic manner, so that the engagement remains secure during use.

This kind of attachment of a boot to a binding is extremely simple and nevertheless functions suitably. The boot is merely hooked into or interlocked with the binding, while each of the interlocking elements is an immobile part of the sole or binding, respectively. To keep the interlocking stable, of course, other means must be provided that act on the boot or its sole in such a way that the boot remains engaged during use. These means preferably comprise elastically pretensioned tensioning means, which when required simultaneously guide the boot laterally and stabilize it. This embodiment is particularly advantageous for downhill skiing.

Another embodiment of the structural principle in accordance with the invention is characterized in that the means acting on the sole or the boot keep it engaged with the binding by holding the front end of the sole down. As a result, the sole of the ski boot in the region between the engagement site and the front end is held firmly to the binding or its upper surface and a constant contact between boot and ski is ensured. This contact is also not broken when in the region between the engagement site and the front end of the sole an elastically yielding element, or flexor, is disposed between sole and binding.

The means acting on the sole or the boot in order to maintain the engagement can be either a tensioning cable that passes around the heel of the boot and keeps the boot in place by exerting a force that tends to pull it forward, or a tensioning cable that passes around the front end of the boot or its sole and keeps the boot in place by exerting a force directed towards the back.

When the front end of the sole is to be held down, it is preferable to use a closing element pivotably mounted on a U- or C-shaped swivel iron and connected to an actuating lever, such that the swivel iron is pivotably mounted on the binding near the sole engagement site and positioned below, about at the same level as, or just above the sole, so that the two arms of the swivel iron extend along the two lateral edges of the sole in a diagonally forward and upward direction, and stabilize the sole and hence the boot at the sides. The swivel iron thus has a double function: firstly it serves to hold the closing element, and secondly its arms simultaneously guide the boot laterally. It is also important that the coupling of the swivel iron is situated near the site of engagement of the sole, either just ahead of or just behind this site. By this means a functionally secure interlocking is achieved entirely by the closing element, with no need for the exertion of very high forces in order to actuate that element.

When in the locked position, the closing element is kept in a position beyond the dead point, where its axis of rotation is above the line connecting the site at which it abuts against the sole and the site at which the U- or C-shaped swivel iron is coupled to the binding. In order to open the closing element and hence the binding, the axis of rotation is brought into a position below said connecting line, by the appropriate imposition of force on an actuating lever connected to the closing element.

The interlocking elements are kept in the engaged position exclusively by the closing element. No separate closing elements in the sole region or on the underside of the sole are required for this purpose.

It should also be mentioned that the interlocking in the toe-joint region of the sole is particularly advantageous anatomically. As a result the foot is minimally constrained during the so-called diagonal step. Because of the additional lateral stabilization of the boot in the last-mentioned embodiment, this is also suitable for so-called skating and in particular for telemark sport.

The pivot bearing or the axis of rotation of the swivel iron is preferably adjustable in its height, in particular so that it can be positioned below the level of the sole, at the same level as the sole, or above it. These adjustments have an influence on the resistance moment when the heel of the boot is raised. The higher the coupling of the swivel iron is positioned, the more rapidly does the resistance moment rise.

In the case in which the means acting on the sole or the boot in order to maintain the interlocking comprises a tensioning cable that passes around the front end of the boot or of its sole, this cable too is coupled to a closing element, which preferably is disposed behind the boot and is accessible. The actual closing mechanism in this embodiment can be disposed below the sole, in particular below the heel of the boot, and can comprise an elbow-lever arrangement which can be brought into a beyond-dead-point closed position by pressing it down with the heel.

Alternatively, it is conceivable for the boot to be fixed to the binding by interlocking means (receiving openings) disposed in the sole-sided region between ball and front end of the sole, in particular in the toe-joint region of the sole, into which are inserted in a lock-like manner retaining hooks that are movably mounted on the binding side.

In principle it holds for all embodiments that for engagement of the sole, on the under surface thereof first interlocking elements are disposed that interact with complementary second interlocking elements on the binding in such a way that in the interlocked state the sole and hence the boot is held to the binding firmly, i.e. substantially without play.

As sole-sided interlocking elements there can be provided at least one, in particular two retaining hooks, which are bent backward and are preferably disposed near the edge of the sole, and which can be inserted into complementary receiving openings on the binding side. These are preferably formed by wire straps bent into approximately a U shape, each of which stands upright with its width oriented transversely with respect to the long direction of the ski or boot. These define openings directed forward and backward to receive the sole-sided retaining hooks.

It is further of quite crucial significance that the sole-sided interlocking elements are so disposed as to lie within the sole, so that they do not project beyond its tread, for which purpose they are situated within recesses in the sole that extend at least in the long direction of the sole. This measure ensures that normal walking while wearing the boot is not hampered by the interlocking elements. The associated recesses in the sole serve for collision-free engagement with the complementary interlocking elements on the binding side. Furthermore, snow or the like can be pushed out of the recesses during the engagement process, i.e. when the sole-sided interlocking elements are being inserted into the binding-sided receiving openings.

In principle it is also conceivable for the sole-sided interlocking elements to be engaged with complementary interlocking elements on the binding by merely inserting the boot and standing in or on the binding (step-in mechanism). However, it is then necessary to open this engagement mechanism manually in order to get out of the binding, for which a special handle is required.

The sole-sided interlocking elements can also consist of at least one, in particular two receiving slots, each disposed near the edge of the sole and opening towards the back, in the form of a receiving fork into which screws or the like disposed on the binding can be inserted in such a way that the heads of the screws overlap the receiving slots. This construction is an alternative to the construction previously described.

It is also conceivable to use as sole-sided interlocking elements at least one, in particular two cross-axles each disposed within a recess near the edge of the sole, which extend approximately parallel to the tread of the sole and can be inserted into hooks or straps that are bent forward and disposed on the binding, so as to become engaged therewith. Alternatively, the sole-sided interlocking elements can be constructed as a retaining iron bent into a U or C shape, With the closing element that acts on the front end of the sole there is preferably also associated an elastic element against the action of which it can be moved past the dead-point line. This elastic element can be part of an arm of the swivel iron that holds the closing element. Alternatively, the elastic element can be disposed between the swivel iron and the closing element itself, as an elastic pressure element between swivel iron and closing element on the side thereof that faces the boot.

Finally, it should be pointed out that a ski brake can be associated with the binding, in particular a ski brake of the conventional kind, which when the boot is inserted into the binding and the front part of the sole is engaged therewith can be pivoted into an inactive travelling position against the action of a torsion spring, and does not return to the braking position until the boot is removed from the binding. For this purpose a sole-contact plate is coupled to the ski brake, at the front end of which a sole abutment is formed. When the boot enters the binding, the front end of the sole is brought into contact with said sole abutment. Then the sole-contact plate is pressed downward and simultaneously the ski brake pivots upward into the travelling position. After this the boot can be pulled backwards relative to the ski so that it interlocks with the binding. This engagement is secured by the closing element described above and its action on the front end of the sole.

Preferably the described interlocking and closing mechanism is situated on a plate that is fixed to the upper surface of the ski or to a binding shell mounted thereon in such a way that it can be swung to the side under the action of a specified limiting torsional load; that is, it can rotate about an axis that is approximately perpendicular to the upper surface of the ski. As a result, the ski binding in accordance with the invention amounts to a safety binding, which is particularly attractive for telemark sport.

BRIEF DESCRIPTION OF THE DRAWINGS

In the following, preferred embodiments of a ski binding or binding arrangement in accordance with the invention are explained with reference to the attached drawings, wherein.

DETAILED DESCRIPTION

Figure 1:
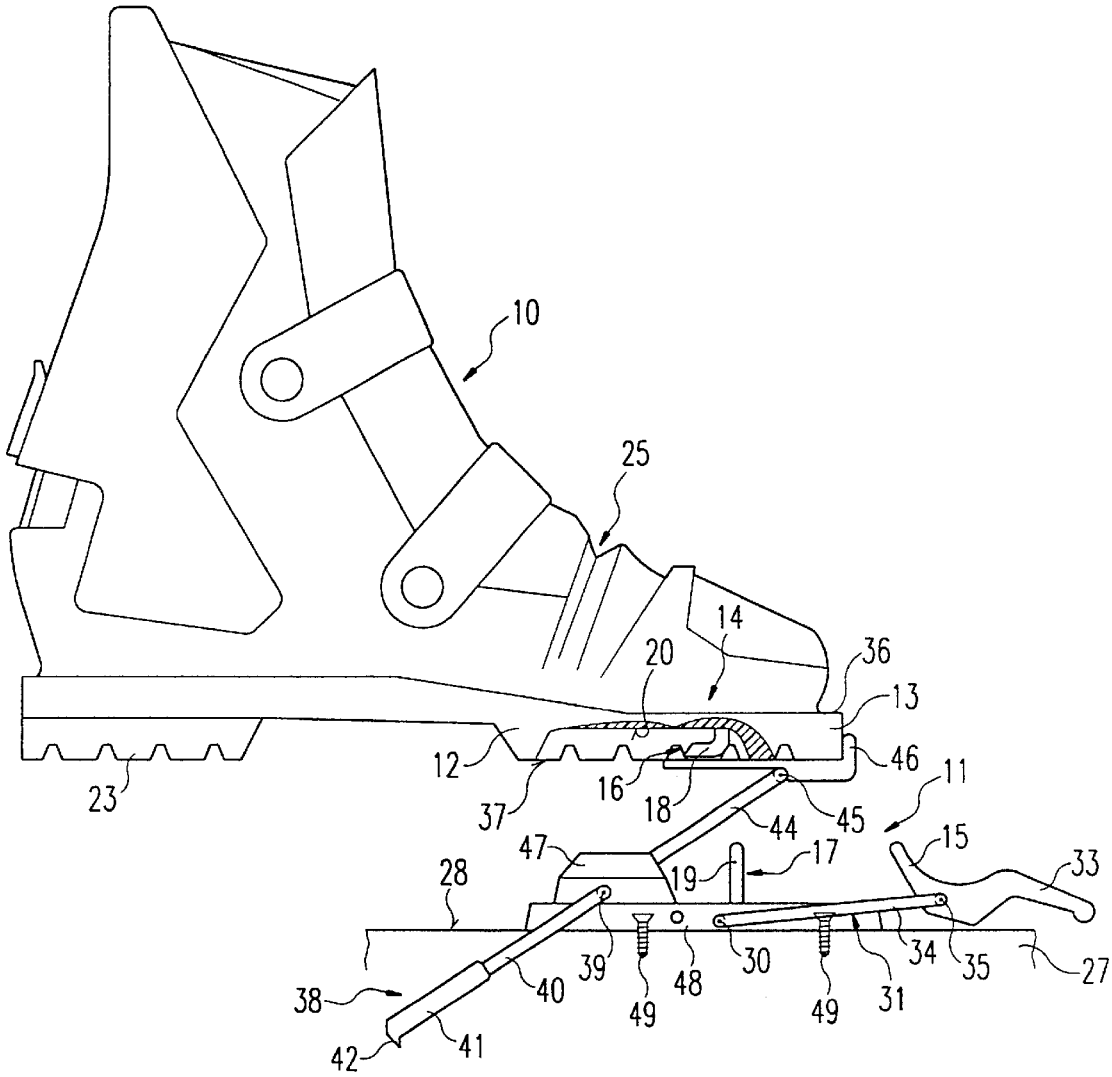
FIG. 1 is a schematic side view of a first embodiment of a binding arrangement in accordance with the invention, which also comprises a ski brake, and the associated boot, shown just before it enters the binding.

FIGS. 1 to 4 show in schematic side and plan view a ski binding, in particular a cross-country or telemark binding, for fixing a front section of a boot 10 in such a way that during use the heel 23 of the boot can be freely raised. Fixation of the boot 10 to the binding, indicated in FIGS. 1 to 4 by the reference numeral 11, is brought about firstly by hooking the sole 12 into place in the region between the ball of the foot and the front end 13 of the sole, in particular in the toe joint region 14 of the sole 12, and secondly by holding the front end 13 of the sole down, additional elements being provided that laterally guide and stabilize the sole 12 or boot 10 while the binding is in use, in particular when the heel 23 of the boot is raised. This lateral stabilization is mediated by a U- or C-shaped swivel iron 31, mounted so as to pivot about an axis 30 and bearing on its cross-piece 32 a closing element 15 that acts on the front end 13 of the sole and is in turn pivotably mounted (axis of rotation 35). Thus the front end 13 of the sole is held down by a closing element 15 that is pivotably mounted on a U- or C-shaped swivel iron 31 and is connected to an actuating lever 33. The swivel iron 31 is mounted on the binding 11 below the sole 12, near the site where the sole is hooked in, and is so arranged that it can pivot about the above-mentioned axis 30, which extends transverse to the long direction of the ski and approximately parallel to the upper surface of the ski. This coupling allows the two arms 34 of the swivel iron 31 to extend past the two lateral edges of the sole in a diagonal, namely upward and forward direction, thus guiding the sole 12 and hence the boot 10 laterally and stabilizing it. In this concrete embodiment, therefore, the swivel iron 31 has a dual function: firstly it provides lateral guidance and stabilization of the boot, in particular when the heel 23 is raised, and secondly it defines the bearing on which the element that acts on the front end 13 of the sole pivots, namely the closing element 15 with its actuating lever 33.

Figure 2:
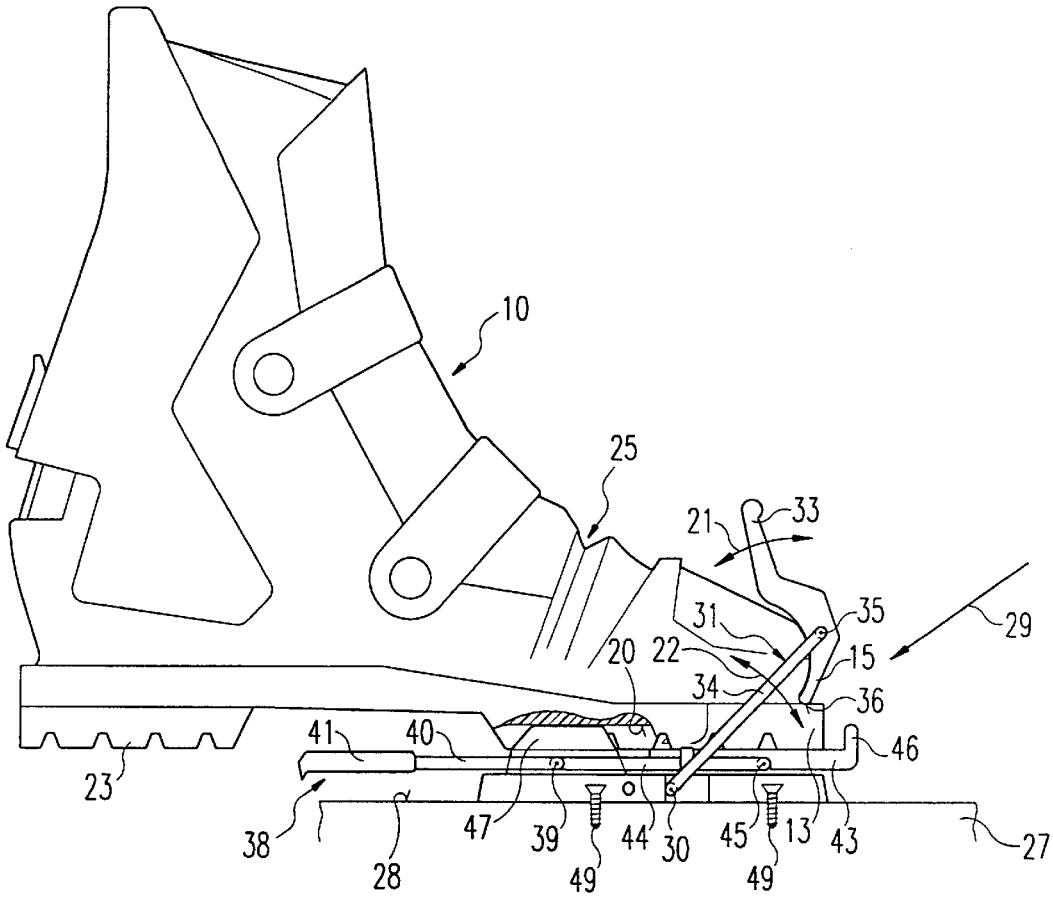
FIG. 2 shows the binding arrangement of FIG. 1 after the boot has entered.

As can be seen in FIG. 2, when the closing element 15 is closed it is held in a position above the dead point; that is, its axis of rotation 35, defined by the cross-piece 32 of the swivel iron 31, is above the line connecting the site 36, where the closing element 15 rests against the sole, and the coupling 30 of the swivel iron 31 to the binding 11.

The interlocking elements in the embodiment illustrated here are held in the engaged position by the closing element 15, and by it alone, as indicated in FIG. 2. To hook the sole 12 into place, on its undersurface there are disposed first interlocking elements 16 that cooperate with complementary second interlocking elements 17 on the binding 11 in such a way that when they are in the engaged position, the sole 12 and hence the boot 10 is fixed firmly to the binding. In the embodiment shown here, the sole 12 becomes hooked into place when it moves backwards, i.e. towards the heel 23, so that the engagement is maintained by the action of the closing element 15 on the front end 13 of the sole when the closing element is in the closed position, shown in FIG. 2.

As sole-sided interlocking elements 16 in the embodiment shown here, two retaining hooks 18, each bent towards the back, are disposed near the edge of the sole so that they can be inserted into complementary receiving openings disposed on the binding. The binding-sided receiving openings here are defined by two wire straps 19 bent into approximately a U shape, each of which stands upright and is oriented transverse to the long direction of ski and boot. As a result, the wire straps 19 form openings through which the sole-sided retaining hooks 18 can pass in the long direction of the ski and boot. Both the retaining hooks 18 and the wire straps 19 are firmly attached, the former to the boot sole 12 by vulcanization and the latter to the binding or binding case. FIGS. 1 and 2 further show that the sole-sided interlocking elements 16, here in the form of backwards-bent retaining hooks 18, are disposed within the sole 12, so that they are below its surface; this is achieved by situating them in recesses 20 that extend in the long direction of the sole. The retaining hooks 18 thus do not project outward or downward beyond the tread of the sole.

It should also be pointed out that the actuating lever 33 with associated closing element 15 can be pivoted about the axis 35 in the direction of the double-headed arrow 21. The swivel iron 31 is pivotable about the axis 30 in the direction of the double-headed arrow 22 (see FIG. 2).

In the region between the interlocking sole elements and the front end 13 of the sole, an elastically yielding element, e.g. a flexor 24, can additionally be disposed between the sole and the binding 11 or the upper surface thereof (see FIGS. 15 to 20).

The upper of the boot 10, in the toe-joint region 14, is also provided with a cross-fold 25, which additionally facilitates raising of the heel 23.

In the present case there are two engagement sites, each disposed near a side edge of the sole 12; together, they define a fixation axis extending transverse to the long direction of the ski and sole and parallel to the tread of the sole, about which the front part of the sole can be rolled or pivoted, against the action of the elastic flexor 24 if the latter is provided. Provision of a flexor 24 is not absolutely necessary, however, as can be seen in FIGS. 1 to 4. When it is not present, of course, the front part of the sole does not pivot about the above-mentioned fixation axis; instead the front section of the sole 12 is held firmly in contact with the binding or its surface, by the interlocking elements on one hand and the closing element 15 on the other.

Figure 4:
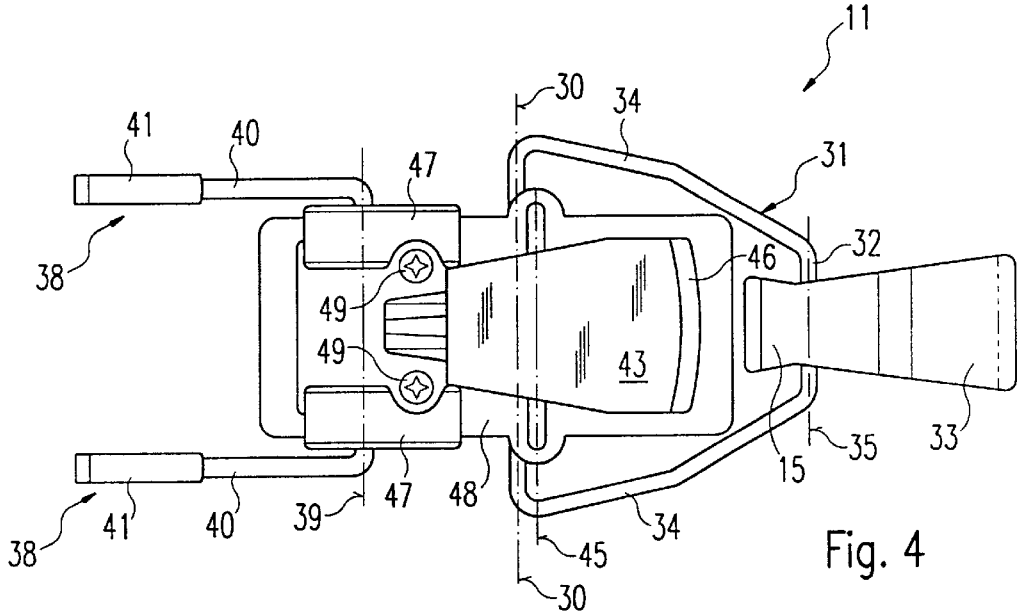
FIG. 4 is a plan view of the binding arrangement according to FIG. 3.
Figure 5:
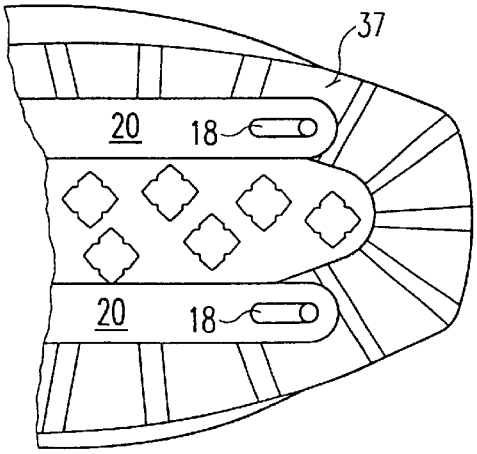
FIG. 5 shows the front part of the sole of a ski boot associated with the binding arrangement according to FIGS. 1 to 4, as viewed from below.

It can be seen in the plan view shown in FIG. 4 that the boot is anchored at three points: the two engagement sites and the front end 13 of the sole. In addition, lateral guidance is provided by the swivel iron 31, in particular when the heel 23 of the boot is lifted in the direction of the arrow 26.

FIGS. 1 and 2 also show part of a ski, identified by the reference numeral 27. The reference numeral 28 indicates the upper surface of the ski.

The closing element 15 exerts force on the front end 13 of the sole in the direction of the arrow 29. This force arrow coincides with the connection line between the axis of rotation 30 of the swivel iron 31 and the site 36 where the closing element 15 is supported on the sole. Accordingly, the closing element 15 presses the front end 13 of the sole downwards and furthermore pushes the boot 10 backwards, thus maintaining the engagement between the elements 16 and 17, more particularly 18 and 19.

As lateral guide elements for the boot 10 it is also possible to use the upright cheeks in the front part of a conventional binding. However, the embodiment described above and shown in FIGS. 1 to 4 is more elegant and less elaborate as well as equally reliable in function. The alternative is mentioned here merely to establish that variously constructed embodiments of the lateral guide elements are conceivable.

The binding arrangement according to FIGS. 1 to 5 is further characterized by the additional integration of a ski brake. This is identified by the reference numeral 38. According to FIGS. 3 and 4 it comprises a fork so mounted as to be pivotable about an axis 39 that extends parallel to the upper surface of the ski and transverse to its long direction; when the boot is released and removed from the binding, the prongs 40 of the fork are acted upon by an elastic element, in particular a torsion spring, in such a way that they rotate downward past the two side walls of the associated ski into a position in which the free ends of the prongs are distinctly below the running surface of the ski. In this position the free ends can become buried in the substrate, in particular snow, so that after the ski has become detached from the boot, it is prevented from sliding uncontrolled down a slope.

In the illustrated embodiment protective caps 41 made of plastic or similar material are pushed over the free ends of the prongs. Preferably these protective caps bear downward-pointing toothlike projections 42 that dig into the substrate, in particular snow, like claws when the ski boot has been released.

Figure 3:
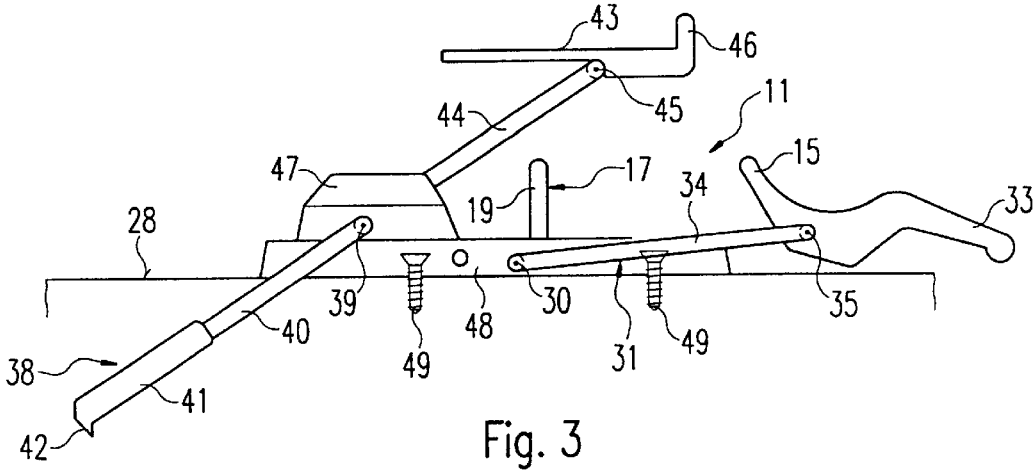
FIG. 3 is a schematic side view of the binding arrangement according to FIG. 1 without boot.

To ensure that when the boot is set into the binding, the prongs 40 of the ski brake are rotated into a position in which they are well above the level of the running surface of the ski, they are attached to a sole-contact element, in particular a sole-contact plate 43, in such a way that when the sole-contact plate 43 is pressed downward by the front part of the sole as the boot enters the binding, the prongs 40 are pivoted upward, namely clockwise in FIG. 3, into the position shown in FIG. 2. The sole-contact plate 43 is rigidly attached to the fork of the ski brake 38 that comprises the prongs 40, in the present case by means of wirelike connecting elements 44 or by wires that are integral with the prongs. At the front, free end of the connecting elements 44 the contact plate 43 is mounted so that it can pivot about an axis 45 that extends parallel to the axis of rotation 39.

The ski brake 38 illustrated and described above is known per se, so that there is no need for a more detailed description here. This applies in particular to the spring that exerts tension on the ski brake when it is in the braking position shown in FIGS. 1 and 3. It is of special significance that the front end of the sole-contact plate 43 comprises a sole abutment 46, i.e. an abutment 46 against which the front end of the sole comes to rest. This makes it possible to fix the position of the ski boot 10 as it is inserted into the binding in such a way that after the sole-contact plate has been pushed down onto the upper surface 28 of the ski or the upper surface of a binding shell 48 mounted on the upper surface 28 of the ski, the sole-sided interlocking elements 16 or 18 are in a position such that they are prepared to become engaged; that is, in the illustrated embodiment, they are directly ahead of the binding-sided interlocking elements 17 or 19. From this position the ski boot 10 needs merely to be pulled slightly backwards in order to achieve the desired engagement of the elements 16, 18 with the elements 17, 19, as shown in FIG. 2. This engagement is maintained, in the embodiment shown in FIGS. 1 to 5, automatically once the actuating lever 33 has been pivoted into the closed position shown in FIG. 2.

Finally, the embodiment according to FIGS. 1 to 5 also comprises the suggestion to extend the recesses in the sole, which accommodate the sole-sided interlocking elements 16 or 18, further backward toward the heel of the boot so as to form sole grooves, which when the boot is seated in the binding correspond to guide ribs 47 formed on the upper surface of the binding shell. The guide ribs are disposed behind the binding sided interlocking elements 17, 19. Below them is the axis of rotation 39 of the ski brake 38.

The shell of the ski binding, which in the embodiment according to FIGS. 1 to 5 has a platelike construction, is identified in these figures by the reference numeral 48. Within this shell are pivotably mounted both the ski brake (about the axis 39) and the swivel iron 31 (axis 30) with closing element 15 and actuating lever 33, as can be readily discerned in FIGS. 1, 2 and 3.

As shown in FIG. 4, the swivel iron 31 in plan view delimits a trapezoid, the shorter side of which is in front and defines the cross-piece 32 that holds the actuating lever 33.

The above-mentioned binding shell 48 is fastened to the upper surface 28 of the ski (the remainder of which is not shown) by screws 49.

Figure 11:
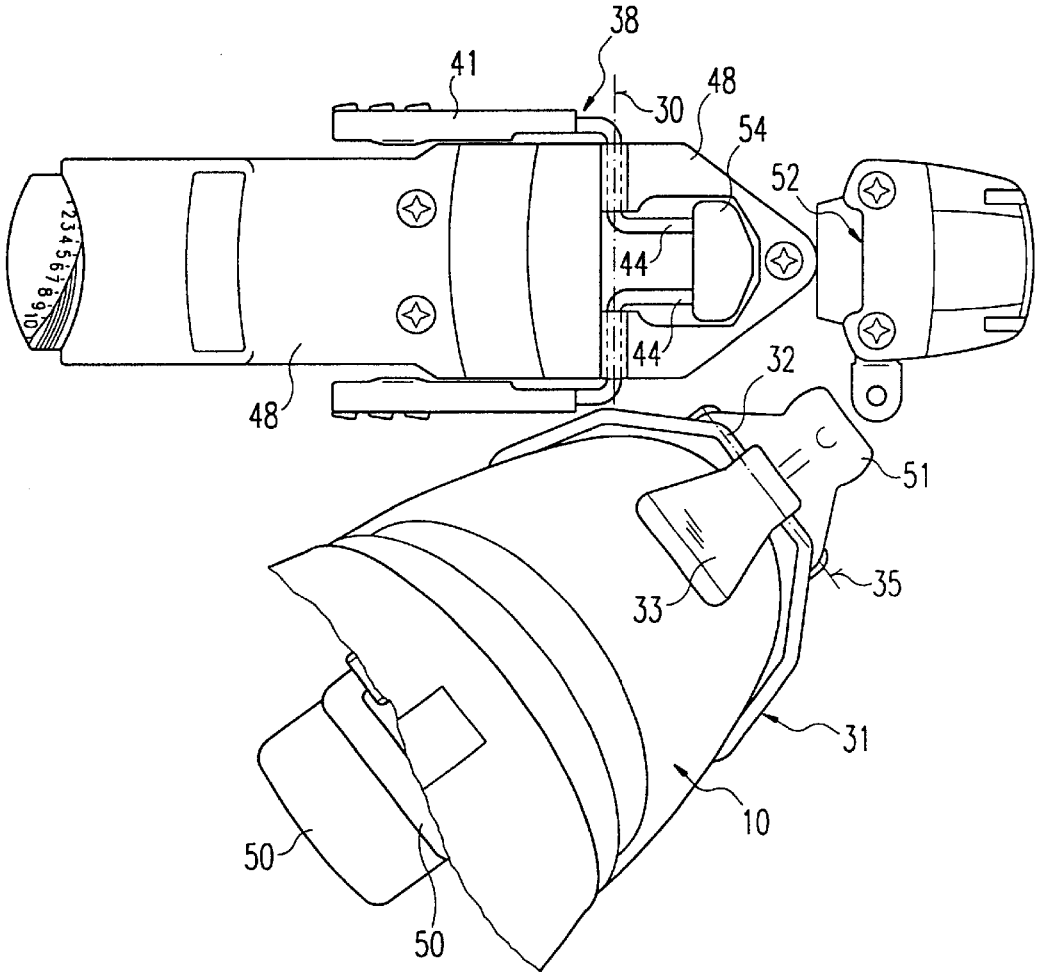
FIG. 11 is a plan view of the binding arrangement according to FIG. 10 showing a boot released after overloading.

The embodiment shown in FIGS. 6 to 11 differs from that according to FIGS. 1 to 5 substantially in that although the ski brake 38 is pivotably (axis 39) mounted on the binding shell 48 in the manner described above, the swivel iron 31 bearing the closing element 15 and actuating lever 33 is not mounted as previously. Instead, this closing mechanism is pivotably held on a separate binding plate 50; that is, the axis of rotation 30 associated with this mechanism runs through said binding plate 50. The binding plate 50 is fixed to the binding shell 48 in the same way as described in the applicant's patent WO 94/27692. In this patent a binding plate is described onto which a ski boot is locked in such a way that the middle part of the foot and the heel can be raised freely from the upper surface of the ski. The binding plate can be swung horizontally to the side, about an axis perpendicular to the upper surface of the ski and against the action of spring-loaded elements in a catch device, and it can swing so far out that it becomes completely detached from the ski as shown in FIG. 11. The furthest forward end 51 of the binding plate abuts against a complementary component at the front end of the binding shell, in such a way that the plate can rotate about its forward end 51. The catch device is associated with the back end of the binding plate 50. The complementary component of the binding shell associated with the front end 51 of the binding plate 50 is identified in FIG. 11 by the reference numeral 52.

Figure 6:
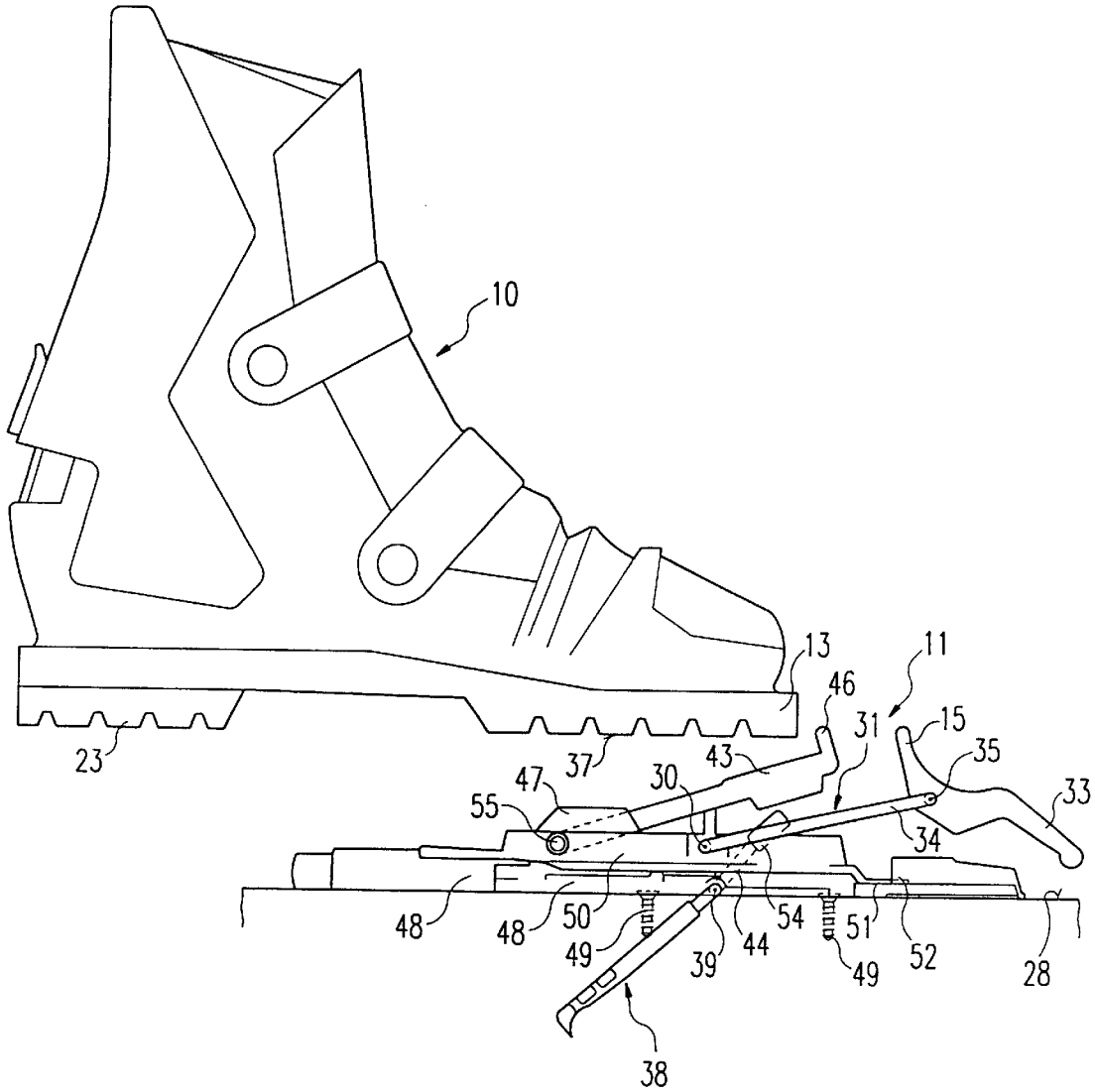
FIG. 6 is a schematic side view of a second embodiment of a binding arrangement constructed in accordance with the invention with associated boot, before the latter enters the binding, wherein this binding arrangement is characterized in that the fixation mechanism for the boot is mounted on a plate that is released upon overloading.
Figure 8:
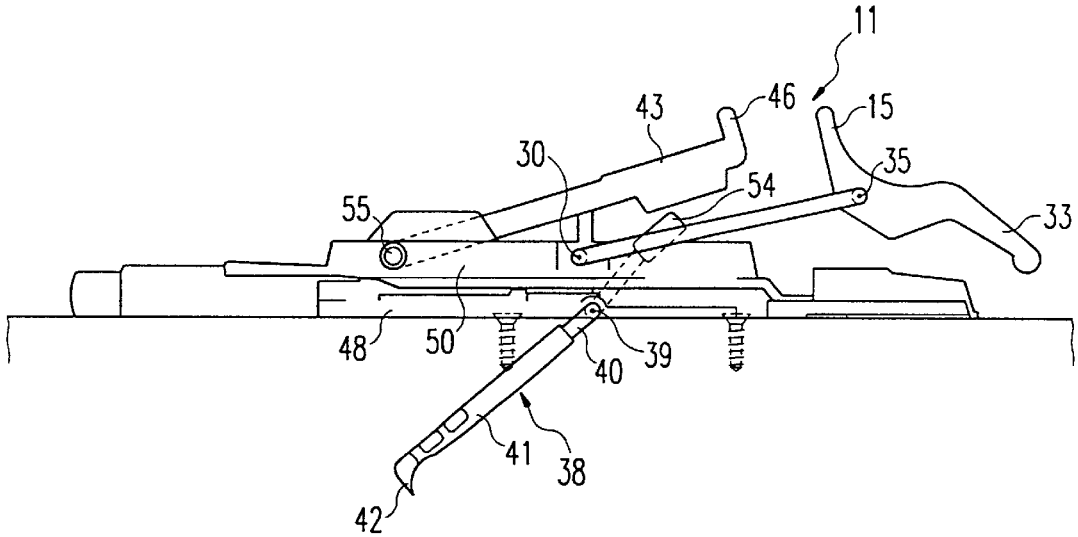
FIG. 8 shows the binding arrangement according to FIGS. 6 and 7 without associated ski boot, in schematic side view.

The binding plate 50 comprises a passageway 53 for a contact element 54 of the ski brake 38 that cooperates indirectly with the front part of the sole of the boot 10, such that the contact between the front part of the sole, specifically the tread 37 of this part of the sole of the boot 10, and the front contact element 54 of the ski brake 38 is mediated by a sole-contact plate 43, which is mounted on the binding plate 50 so that it is pivotable about an axis 55 that extends approximately parallel to the upper surface 28 of the ski and perpendicular to the long direction of the ski (see FIGS. 6 and 8).

Figure 7:
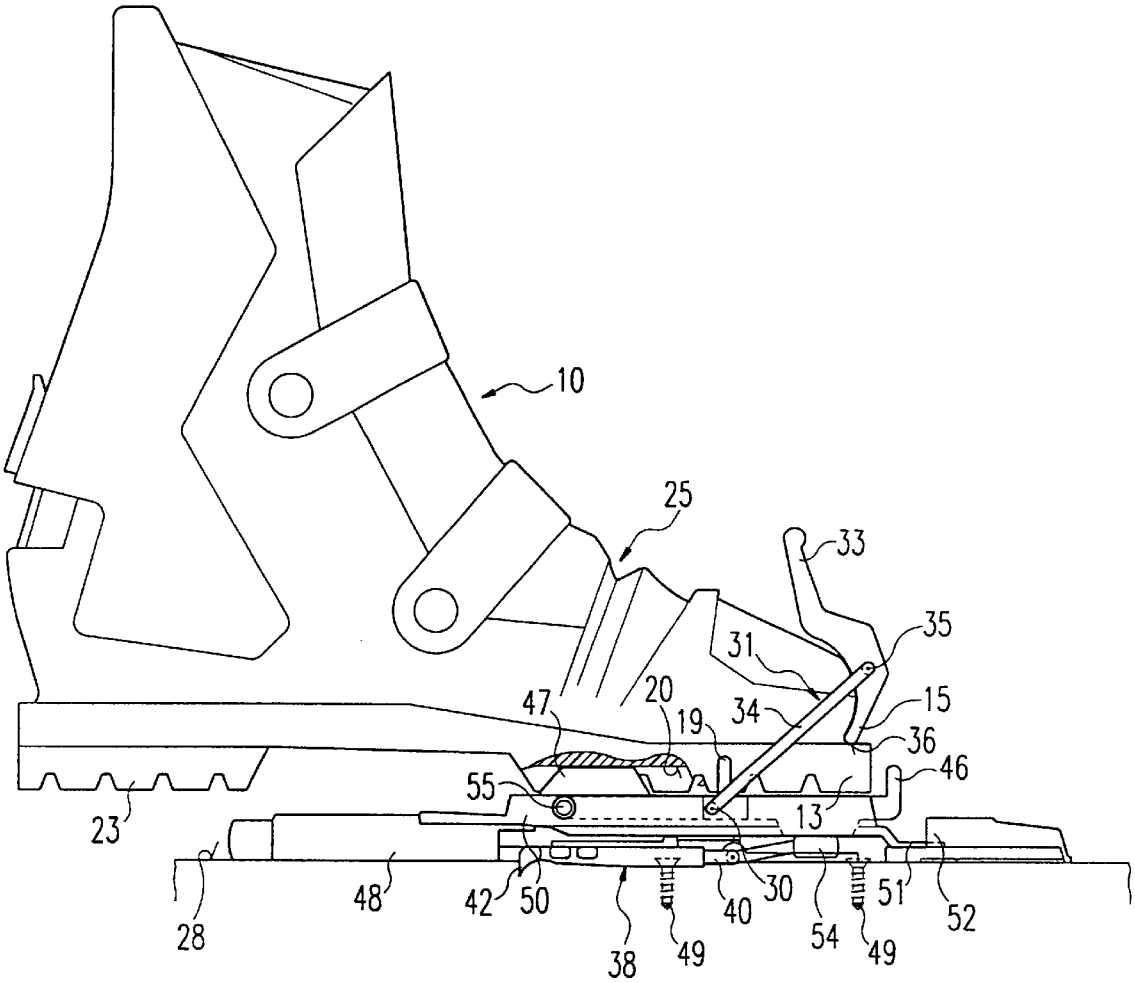
FIG. 7 is a schematic side view of the binding arrangement according to FIG. 6 with boot fixed to the binding.

At the front end of the sole-contact plate 43, as in the embodiment according to FIGS. 1 to 5, an upward-projecting abutment 46 for the front end of the sole of the boot 10 is formed. When the boot 10 enters the binding, the front end of its sole comes into contact with the abutment 46. Then the sole-contact plate 43 is pressed downward, and simultaneously the brake prongs 40 of the ski brake 38 are pivoted into a position above the level of the running surface of the ski, where they are approximately parallel to the long direction of the ski as shown in FIG. 7. Thereafter the boot is fixed to the binding plate 50 by the closing element 15 in the manner described above, such that the boot is pushed slightly backward on the sole-contact plate 43, into a position according to FIG. 7. This backward displacement hooks the sole-sided interlocking elements into the binding-sided interlocking elements as described above, so that the ski boot 10 is fixed to the binding plate 50 and hence to the binding 11 as described at the outset. Also disposed on the upper surface of the binding plate 50 are the guide ribs 47 described with reference to FIGS. 1 to 5, which correspond to complementary grooves on the under surface of the sole of the ski boot 10. These serve to increase lateral stability and, in particular when travelling in a curve, help to control the ski by transferring laterally directed forces from the boot to the ski by way of the binding 11. If these forces become excessive because of a fall, the binding plate 50 becomes detached from the binding shell 48 and hence from the ski, in the manner described by the applicant in the application cited above and also illustrated in FIG. 11.

Apart from this difference, the components of the embodiment according to FIGS. 6 to 11 function in the same way as the components identified by the same reference numerals in the embodiment according to FIGS. 1 to 5.

It should again be pointed out at this juncture that both the sole-sided and the binding-sided interlocking elements in accordance with the invention are constructed so as to be immobile; that is, they comprise no parts that can move relative to the sole or the binding shell. The only movable component of the closing mechanism is the closing element 15 along with the actuating lever 33 and swivel iron 31. This makes the binding in accordance with the invention particularly simple but nevertheless highly ergonomic and reliable in function, especially for telemark skiing.

Figure 12:
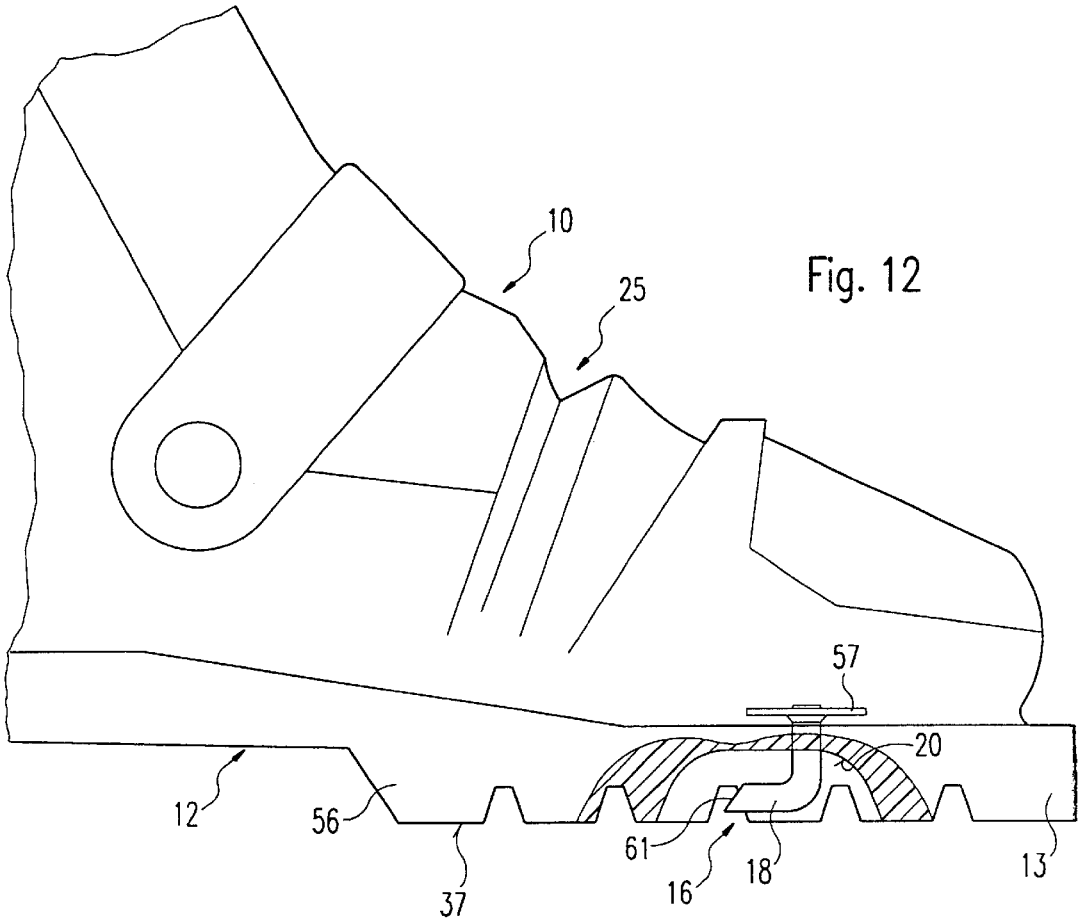
FIG. 12 is a schematic side view of a ski boot constructed in accordance with the invention, partially in longitudinal section (front part of sole)

In FIG. 12 the front half of a ski boot 10 in accordance with the invention is shown in schematic side view, partially in schematic longitudinal section (front part of sole). In this ski boot the front part 56 of the sole comprises two recesses 20, each disposed near the edge of the sole and within each of which an interlocking element 16 in the form of a backwards-bent retaining hook 18 is positioned in such a way that its entire extent is within the recess, so that it does not project outward beyond the tread 37 of the sole. This ski boot has been described above in connection with the previously described binding arrangement, with reference to FIGS. 1 and 2. The present reference to FIG. 2 is made in order to document that the boot per se is likewise regarded as invention, i.e. it is independent of the previously described binding arrangement. This ski boot is characterized in that when necessary it can be used as a walking boot, as long as the sole 12 is sufficiently flexible to bend appropriately, e.g. consists of a suitable hard-rubber mixture.

At its end on the inner surface of the sole the retaining hook 18 is provided with an anchoring plate 57. This anchoring plate 57, which is preferably disk-shaped, is positioned between the insole and the sole 12 of the boot 10 and ensures that the hook 18 is securely fixed within the sole recess 20. The back end of the retaining hook 18 is somewhat slanted, so that the surface slopes upward from back to front. This bevelling, identified by the reference numeral 61, makes it easier to insert the hook into the binding-sided interlocking element, namely a retainer or wire strap 19 as described above.

Figure 13:
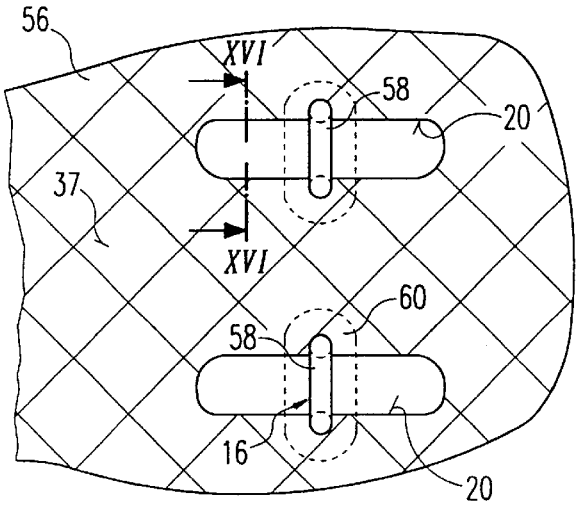
FIG. 13 is a plan view of the front sole part of a modified ski boot.
Figure 14:
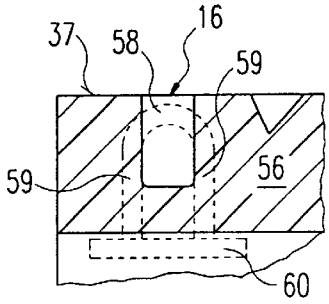
FIG. 14 shows the front sole part of the boot according to FIG. 13 in section along the line XVI—XVI in FIG. 13.

In FIGS. 13 and 14 a modified embodiment of a ski boot in accordance with the invention is represented by drawings that show only the structures of interest in the front part of the sole, as viewed from below and in partial cross section along the line XVI—XVI in FIG. 13. This embodiment is distinguished by the fact that the sole-sided interlocking elements 16 comprise retaining straps 58 bent into a U or C shape and positioned within the sole recesses 20 in such a way that each extends transverse to the long direction of the sole and does not extend beyond the tread 37 of the sole, as is clearly visible in FIG. 14.

FIG. 14 also shows that the open space between the two arms 59 of the retaining strap 58 has the same width as the open space within the entire recess 20 in the direction transverse to the long direction of the sole. This embodiment thus offers the great advantage that the recess 20 in the sole can be made very narrow as compared with the recess 20 in the embodiment according to FIG. 12, because in the latter case the recess 20 must be at least wide enough, in the direction transverse to the long direction of the sole, that an associated wire strap can be inserted into the recess over its full width. Accordingly, the recesses 20 in the embodiment according to FIGS. 13 and 14 can be made considerably narrower than in the embodiment according to FIG. 12.

On the insole side, the arms 59 of the retaining strap 58 are connected to one another by a disk-like anchoring plate 60, which has the same anchoring function as the anchoring plate 57 in the embodiment according to FIG. 12.

FIG. 13 also makes clear that the sole recesses 20 are preferably constructed as longitudinal grooves extending approximately parallel to the long direction of the sole.

Figure 9:
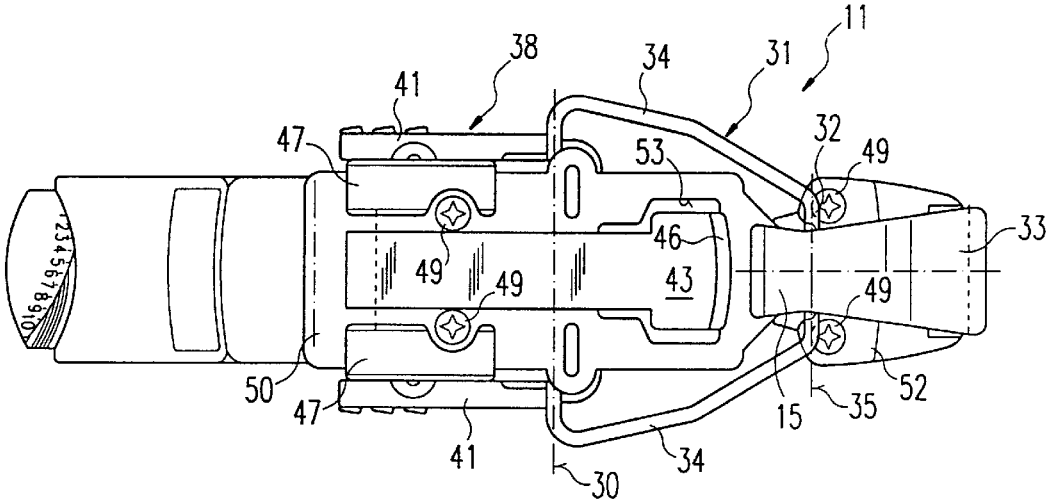
FIG. 9 is a plan view of the binding arrangement according to FIG. 8.
Figure 10:
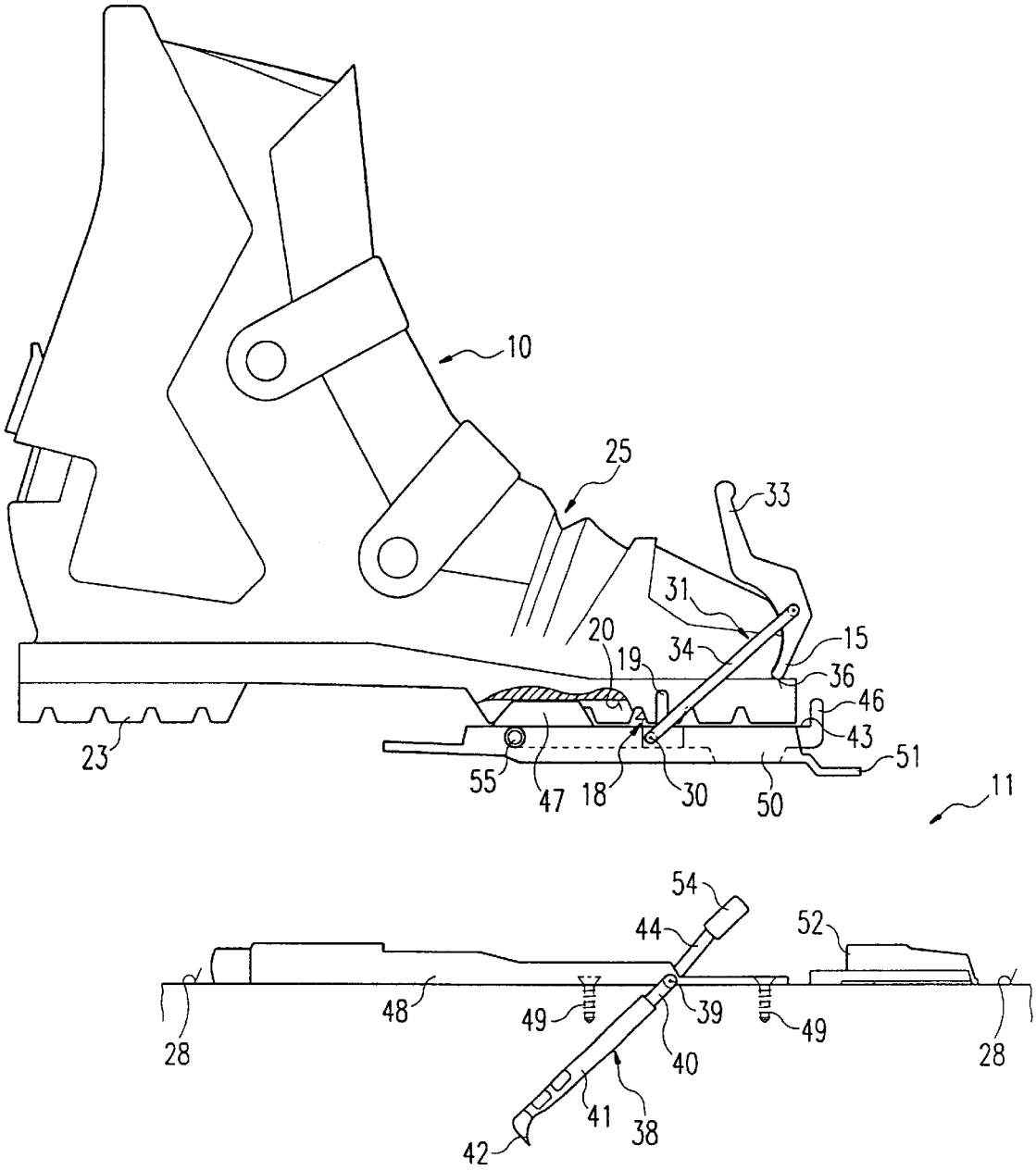
FIG. 10 shows the binding arrangement according to FIGS. 6 to 9 after release from the ski owing to the action of an overload.

Regarding the passageway 53 in FIG. 9 for the contact element 54, it should be mentioned that this element does not interfere with release of the binding plate 50 by swinging sideways under overload, because as long as the boot 10 is held firmly on the binding plate 50, the sole-contact plate 43 is also pressed downward in such a way that its lower surface is flush with the lower surface of the binding plate 50. The underside of the sole-contact plate 43 presses the contact element 54 so far downwards that the binding plate 50 can swing out to the side without colliding with the contact element 54. The end of the contact element 54 that cooperates with the lower surface of the sole-contact plate 43 or the underside of the binding plate 50 is preferably rounded, so that when the binding plate 50 swings out to the side and is released, along with the boot, from the binding shell 48, the binding plate cannot become engaged with the contact element so as to prevent the binding plate from swinging outward.

The construction just described makes it possible for the ski brake to operate effectively whenever the boot is not yet fixed to the binding plate, i.e. has not yet entered the binding or has been removed from the binding, or whenever the binding plate 50 together with the boot 10 is released from the binding shell 48 owing to overloading caused by a fall or the like, as a result of which the binding plate 50 swings out to the side relative to the binding shell 48 as described above, about an axis that extends approximately perpendicular to the upper surface 28 of the ski.

Figure 15:
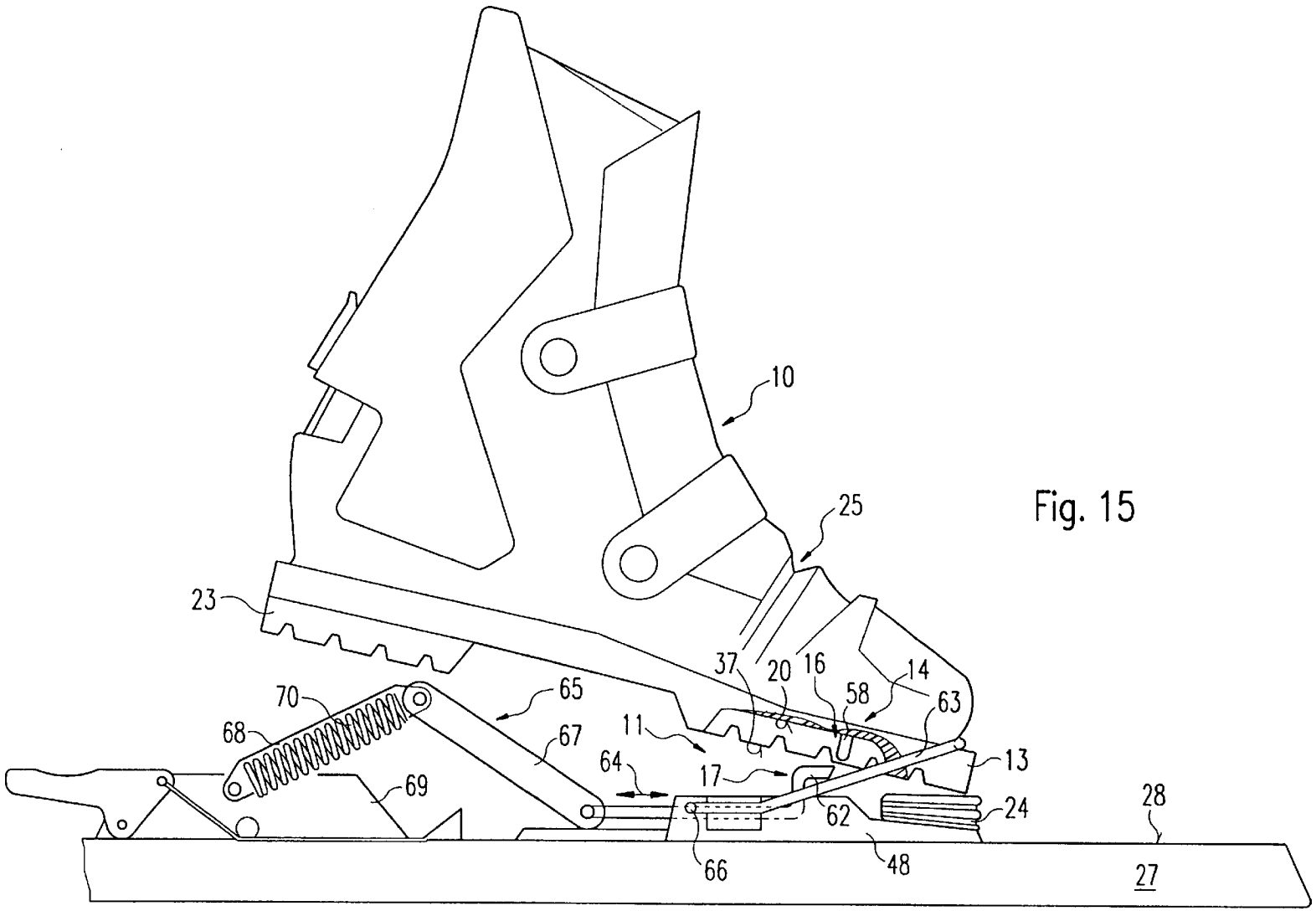
FIG. 15 is a schematic side view of a third embodiment of a binding arrangement in accordance with the invention, showing the associated boot being inserted into the binding, wherein this binding arrangement comprises a retaining hook on the binding side, mounted so as to be longitudinally displaceable, and a closing mechanism coupled thereto.
Figure 16:
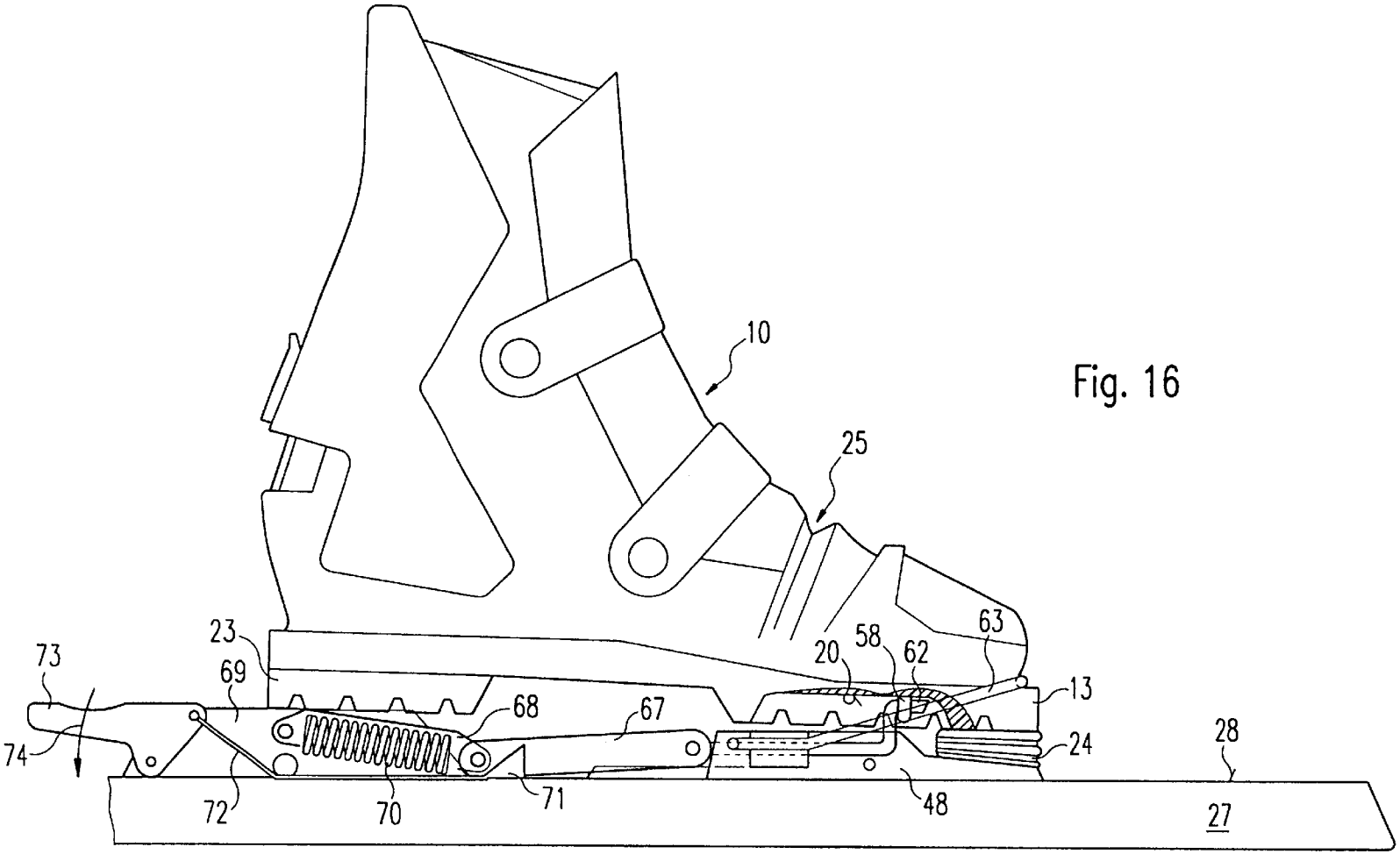
FIG. 16 shows the binding arrangement according to FIG. 15 after the boot has been inserted.

In FIGS. 15 and 16 a third embodiment of a binding arrangement in accordance with the invention with associated boot 10 is shown in schematic side view. This binding arrangement comprises a retaining hook 62 with which is coupled a closing mechanism 65, disposed in the binding shell 48 so as to be longitudinally displaceable (in the direction of the double-headed arrow 64). FIG. 15 shows the binding arrangement while the associated boot is being inserted into the binding, whereas FIG. 16 shows binding arrangement and boot after insertion has been completed.

To fix the boot 10 to the binding 11, the front end of the sole 13 is inserted under a retaining iron 63, mounted on the binding shell 48 so as to be pivotable about a transverse axis 66, as shown in FIG. 15. The retaining iron 63 is approximately U- or C-shaped. The cross-piece at the front of the retaining iron 63 also serves as a stop against which the front end of the boot abuts when it is inserted into the binding. In this stopped position the boot 10 can be moved downward, so that the interlocking elements 16 on the sole side are in the right place to become hooked into the binding-sided interlocking elements 17. The sole-sided interlocking elements are U- or C-shaped retaining straps 58, positioned within recesses 20 in the sole near its longitudinal edges so that they are oriented transverse to the long direction of the sole and do not extend beyond the tread 37 of the sole, as can readily be seen in FIGS. 15 and 16. In this regard reference is also made to the description of FIGS. 13 and 14. As mentioned above, the binding-sided retaining hooks 62 are mounted within the binding shell 48 in such a way that they can be shifted back and forth. The back ends of the retaining hooks 62 are connected to a heel plate 69 by way of an elbow-lever arrangement consisting of front and back levers 67, 68. The connection between the two levers is a hinge joint, as are the connections between the front lever and the back end of the longitudinally displaceable retaining hook 62 and between the back lever 68 and the heel plate 69. In the position of the longitudinally displaceable retaining hook or hooks 62 in which the boot is released, as shown in FIG. 15 the levers 67, 68 of the elbow-lever arrangement are deflected upward; the hinge joint between the levers 67 and 68 is accordingly above the dead-point line, which is defined as a direct line between the front attachment of the front lever 67 to the back end of the longitudinally displaceable retaining hook or hooks 62 and the back attachment of the back lever to the heel plate 69. In this boot-release position the longitudinally displaceable retaining hook or hooks 62 is/are held in place by a tension spring, namely the extension spring 70, the pulling force of which is exerted between the hinge joint connecting the front and back levers, on one hand, and the heel plate 69 on the other hand.

When the heel 23 of the boot is lowered after the front end 13 of the sole has been inserted below the retaining iron 63 as described above, the heel presses the elbow lever 67, 68 downwards until the hinge joint between front and back lever has moved below the dead-point line defined above, as is shown in FIG. 16. As a result, the retaining hooks mounted in the binding shell 48 so as to be longitudinally displaceable are shifted forward and move into the openings defined by the retaining straps disposed within the sole. The retaining hooks 62 then are in the closed position, fixing the boot as shown in FIG. 16.

As it descends, the hinge joint between front and back levers 67, 68 forces a longitudinally displaceable opening wedge 71, mounted in the heel plate 69, to move forward out of the position shown in FIG. 15 and into a position corresponding to FIG. 16. This opening wedge 71 is connected by way of a connecting cable 72 or the like to an actuating lever 73 that is pivotably mounted on the heel plate 69. When this actuating lever 73 is rotated downwards, in the direction of the arrow 74 in FIG. 16, the opening wedge 71 moves backwards and simultaneously raises the hinge joint between front and back lever 67, 68 above the dead-point line, with the consequence that when the heel 23 of the boot is lifted up, the retaining hooks 62 are pulled back into the boot-release position. This backward movement is caused by the action of the tension spring 70, which becomes effective after the hinge joint between front and back levers 67, 68 has been moved upwards beyond the dead-point line.

The embodiment according to FIGS. 15 and 16 is further characterized by the fact that between the front end of the sole and the upper surface 28 of the ski, or the front end of the binding shell 48, a flexor 24 is disposed. The action of this element has been discussed in detail above.

Figure 17:
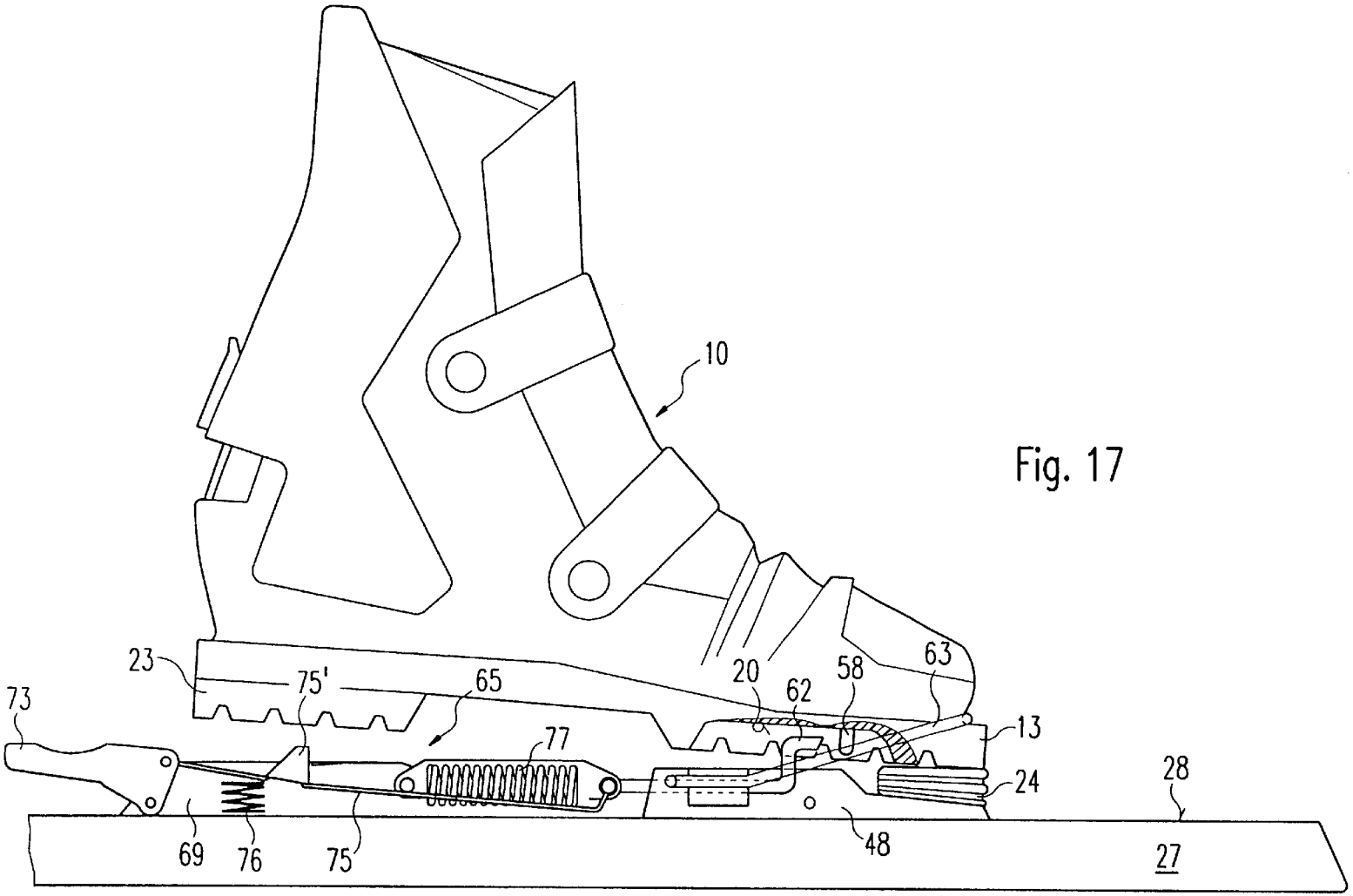
FIG. 17 shows a fourth embodiment of a binding arrangement in accordance with the invention with binding-sided, longitudinally displaceable retaining hook coupled to a closing mechanism, in schematic side view corresponding to that of FIG. 15.
Figure 18:
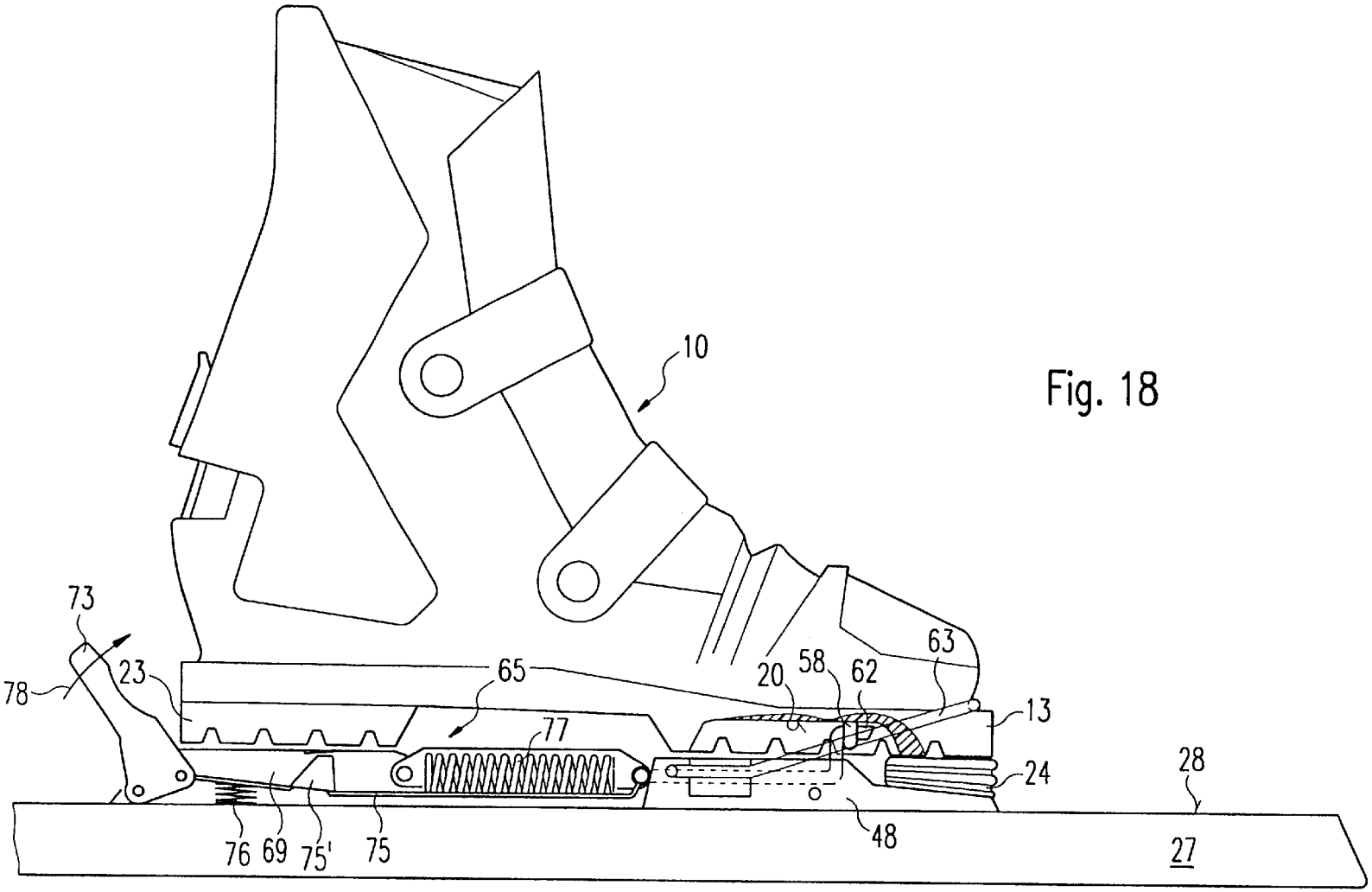
FIG. 18 shows the binding arrangement according to FIG. 17 after insertion of the boot into the binding.

The embodiment according to FIGS. 17 an 18 is comparable to that according to FIGS. 15 and 16 with respect to the interlocking mechanism. Furthermore, the embodiment according to FIGS. 17 and 18 also comprises one or two retaining hooks 62 mounted so as to be longitudinally displaceable. The difference between the embodiment according to FIGS. 17 and 18 and that according to FIGS. 15 and 16 resides merely in the closing mechanism 65 for the retaining hook or hooks 62. The closing mechanism 65 is formed by a direct connection between the back end of the longitudinally displaceable retaining hooks 62 and an actuating lever 73 pivotably mounted behind the boot heel, on a heel plate 69. On the upper side of this connection 75 a projection 75' is formed which, when the retaining hooks 62 are in the boot-release position shown in FIG. 17, extends upwards beyond the upper surface of the heel plate 69. When the heel 23 of the boot is lowered, this projection 75' is pressed downwards, against the action of an elastic element 76. As soon as the projection 75' descends below the upper surface of the heel plate 69, a compression spring 77 that acts between the front binding shell 48 and the heel plate 69 pushes the retaining hooks 62 forwards, so that simultaneously the connection 75 moves forwards and the actuating lever 73 is pivoted upward in the direction of the arrow 78 in FIG. 18. When this action is completed, the retaining hooks 62 are in the closed position, fixing the boot as shown in FIG. 18. The projection 75' is now within the heel plate 69, below its upper surface. In order to remove the boot from the binding, the actuating lever 73 must be rotated downwards, in a direction opposite to the arrow 78 in FIG. 18. Then the projection 75' returns to a position in which, under the action of the spring 76, it can again move upwards and out of the heel plate, through an opening in the upper surface of the heel plate 69 (FIG. 17).

Figure 19:
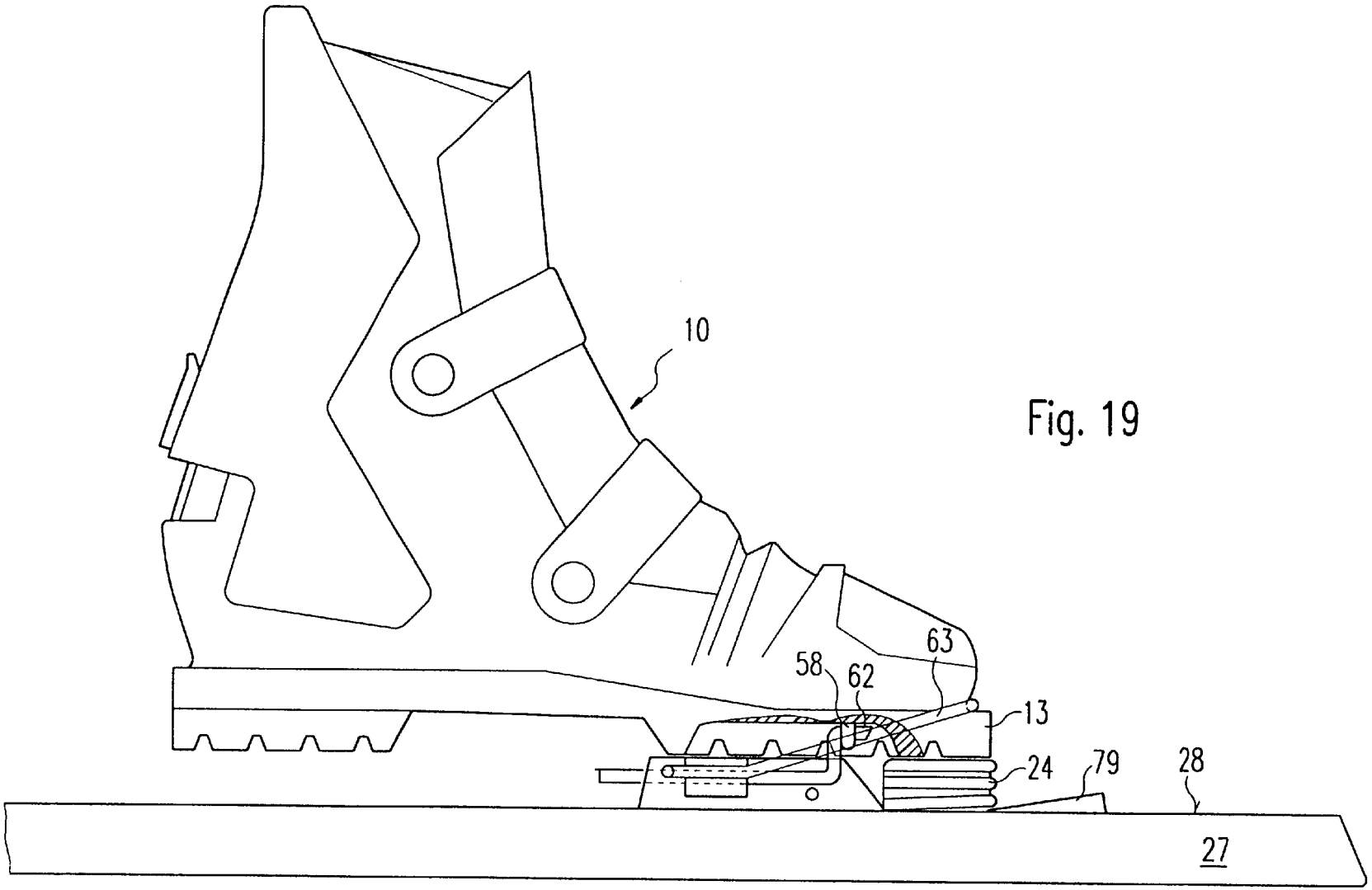
FIGS. 19 and 20 are schematic side views of a means for influencing a flexor between the front end of the sole and upper surface of the ski, for a binding arrangement according to FIGS. 15 to 18.
Figure 20:
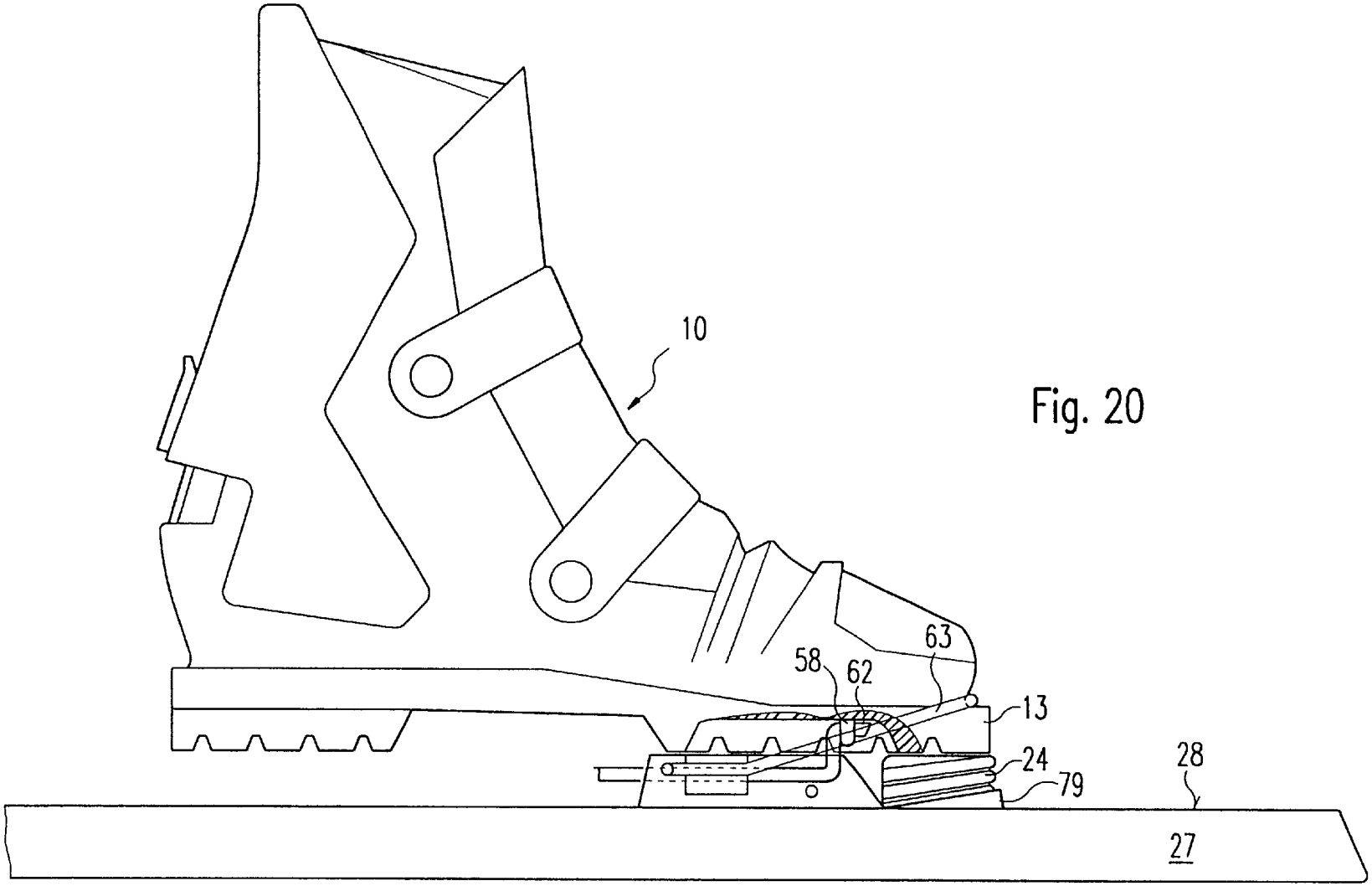

FIGS. 19 and 20 show how it is possible to affect the flexor 24 disposed between the front end of the sole and the upper surface of the ski, by means of a wedge 79 that can be pushed between the flexor 24 and the ski surface. In other respects the embodiment shown in FIGS. 19 and 20 corresponds to that according to FIGS. 15, 16 and 17, 18, respectively.

Figure 21:
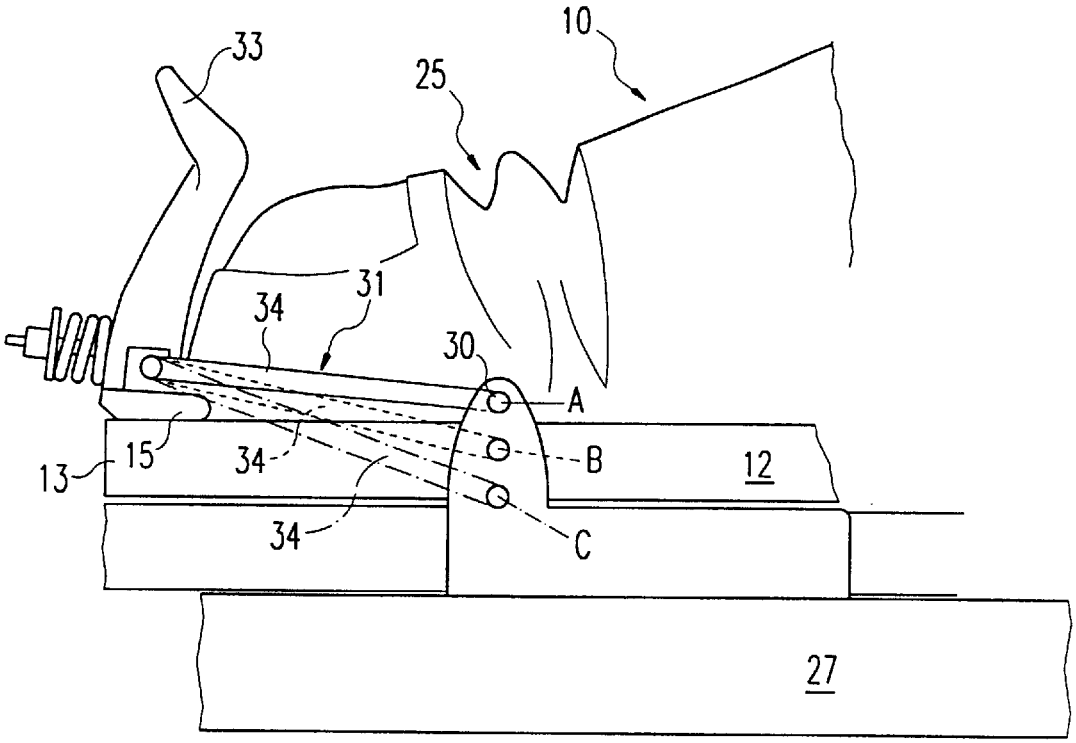
FIG. 21 is a schematic side view of a fifth embodiment of a binding arrangement in accordance with the invention corresponding to FIGS. 1 and 2, showing how a front swivel iron with closing element is coupled to the binding at different heights relative to the sole of the boot.
Figure 22:
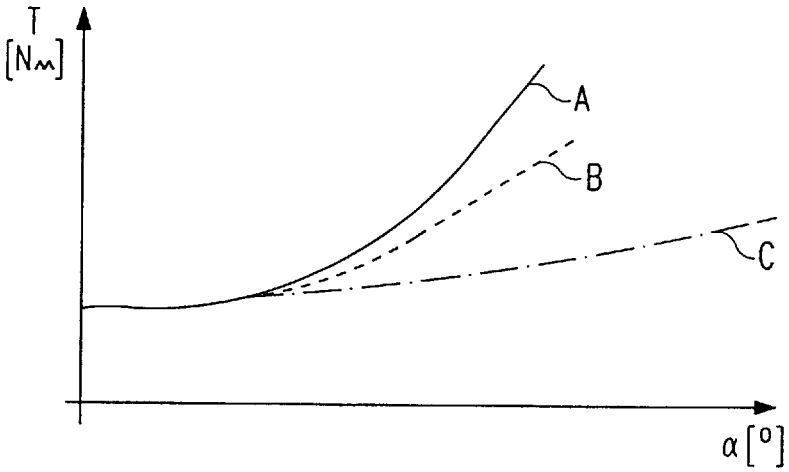
FIG. 22 is a graph of the resistance moment as a function of the angle a between boot sole and upper surface of ski when the boot heel is raised, for the swivel-iron coupling points A, B and C in FIG. 21.

In FIG. 21 an embodiment corresponding to FIGS. 1 to 4 is shown. The embodiment according to FIG. 21 is distinguished by the fact that the axis of rotation 30 of the swivel iron 31 can be adjusted to different heights as desired, namely just below the sole 12 (position C), at about the same level as the sole 12 (position B) or just above the sole 12 (position A). By thus varying the position of the axis about which the iron 31 pivots, the resistance moment T associated with raising the heel of the boot can be correspondingly varied. FIG. 22 shows the qualitative difference between the resistance moments for the positions A, B and C as a function of the angle ax between boot sole and upper surface of ski.

Figure 23:
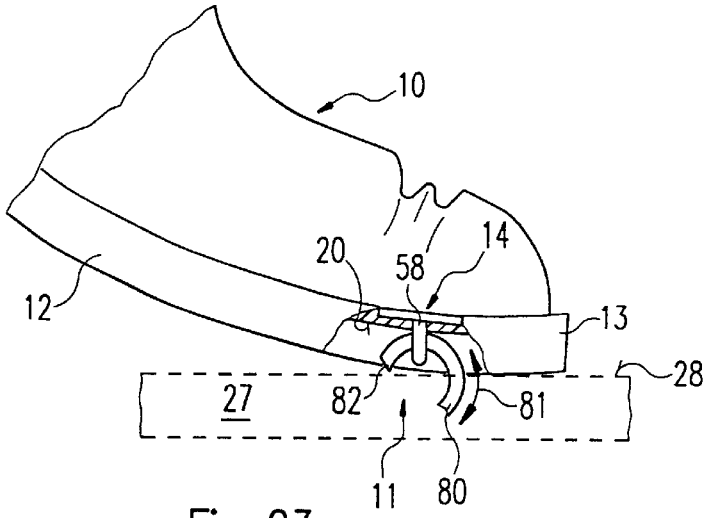
FIG. 23 is a schematic side view of a sixth embodiment of a binding arrangement in accordance with the invention, comprising a locking bolt.

In the embodiment according to FIG. 23, the boot 10 is fixed to the binding 11 by retaining hooks 80 pivotably mounted on the binding side, which are inserted like a lock into sole-sided interlocking means (receiving openings) disposed in the region between the ball of the sole and its front end 13, in particular in the toe-joint region 14 of the sole 12. The sole-sided interlocking elements consist of at least one, in this case two retaining straps 58 bent into a U or C shape and each disposed near the edge of the sole in a recess 20 (see FIGS. 13, 14), into which can be inserted one or in this case two round hooks 80 disposed on the binding side so as to be rotatable about an axis that extends transverse to the long direction of the ski and approximately parallel to its upper surface 28, which are connected to a handle, in particular a swivelling lever not shown here. With this arrangement, no additional devices are required to fix the boot 10 to the binding 11. The pivotability of the round hook 80 is indicated in FIG. 23 by the double-headed arrow 81.

For the boot to be removed from the binding, of course, the round hook 80 must be rotated far enough that its free end becomes disengaged from the retaining straps 58. The free end of the round hook or hooks 80 is somewhat sharpened and in FIG. 23 is identified by the reference numeral 82.

Figure 24:
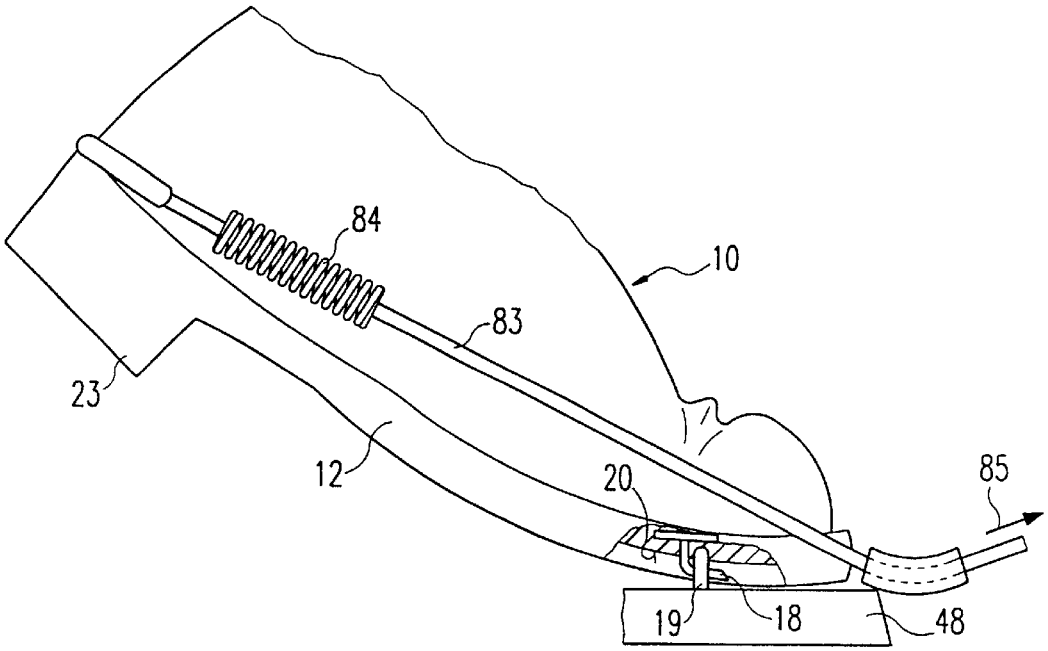
FIG. 24 is a schematic side view of a seventh embodiment of a binding arrangement in accordance with the invention, comprising a tensioning cable that passes around the heel of the boot.

The embodiment according to FIG. 24 is characterized in that the sole 12 of the boot 10 comprises retaining hooks 18 that are bent forward and correspond to complementary retaining straps 19 in the binding (binding shell 48) as shown in FIG. 24. Here the interlocking elements 18, 19 are kept in the engaged position by a tensioning cable 83 that passes around the heel 23 of the boot. This cable comprises at least one tension-spring element 84. The front end of the tensioning cable is connected to a closing-lever mechanism (not shown). Because in these respects it is a known construction, no further illustration or explanation is needed here. The important point is merely that the boot 10 is held in place exclusively by the interlocking elements 18, 19 and the tensioning cable 83 that passes around the heel 23 of the boot. Accordingly, this embodiment again has the simplest conceivable construction, which can be considered as an alternative to the construction according to FIGS. 1 to 5.

All the characteristics disclosed in the application documents are claimed as essential to the invention insofar as they are new to the state of the art individually or in combination.

| List of reference numerals | |
|---|---|
| 10 | Boot |
| 11 | Binding |
| 12 | Sole |
| 13 | Front end of sole |
| 14 | Toe-joint region |
| 15 | Closing element |
| 16 | First interlocking elements |
| 17 | Second interlocking elements |

-continued

| List of reference numerals | |
|---|---|
| 18 | Retaining hook |
| 19 | Wire strap |
| 20 | Recess in sole |
| 21 | Double-headed arrow |
| 22 | Double-headed arrow |
| 23 | Heel of boot |
| 24 | Flexor |
| 25 | Cross-fold |
| 26 | Arrow |
| 27 | Ski |
| 28 | Upper surface of ski |
| 29 | Force arrow |
| 30 | Axis of rotation |
| 31 | Swivel iron |
| 32 | Cross-piece |
| 33 | Actuating lever |
| 34 | Arm |
| 35 | Axis of rotation |
| 36 | Sole-abutment site |
| 37 | Tread of sole |
| 38 | Ski brake |
| 39 | Axis of rotation |
| 40 | Prongs of brake |
| 41 | Protective cap |
| 42 | Tooth projection |
| 43 | Sole-contact plate |
| 44 | Connecting element |
| 45 | Axis of rotation |
| 46 | Sole abutment |
| 47 | Guide rib |
| 48 | Binding shell |
| 49 | Screws |
| 50 | Binding plate |
| 51 | Front end of binding plate |
| 52 | Front component of binding shell |
| 53 | Passageway |
| 54 | Contact element |
| 55 | Axis of rotation |
| 56 | Front part of sole |
| 57 | Anchoring plate |
| 58 | Retaining strap |
| 59 | Arm |
| 60 | Anchoring plate |
| 61 | Bevelled surface |
| 62 | Displaceably mounted retaining hook |
| 63 | Retaining iron |
| 64 | Double-headed arrow |
| 65 | Closing mechanism |
| 66 | Transverse axis |
| 67 | Front lever |
| 68 | Back lever |
| 69 | Heel plate |
| 70 | Tension spring |
| 71 | Opening wedge |
| 72 | Connecting cable |
| 73 | Actuating lever |
| 74 | Arrow |
| 75 | Connection |
| 75' | Projection |
| 76 | Elastic element |
| 77 | Compression spring |
| 78 | Arrow |
| 79 | Wedge |
| 80 | Retaining hook (round hook) |
| 81 | Double-headed arrow |
| 82 | Free end of the round hook |
| 83 | Tensioning cable |
| 84 | Tension spring |
| 85 | Arrow |

What is claimed is:

1. A ski binding system, comprising:

a boot having a forefoot portion, a heel portion and a sole with a tread on the underside of said sole;

a binding fixedly attached to a ski; and at least one interlockable hook and strap for connecting said boot to said binding, one of said hook and strap comprising a static member rigidly fixed to said binding, the other of said hook and strap comprising a static member rigidly fixed to said boot near a side edge of said sole within said forefoot portion, said other of said hook and strap positioned with its full extent accommodated within said sole such that said other of said hook and strap does not extend beyond the tread of said sole;

wherein said binding further comprises means for selectively exerting and releasing an at least partially rearwardly directed force on said forefoot portion of said boot, to maintain said hook and strap in an interlocked state while permitting the heel portion of said boot to be raised.

2. The ski binding system of claim 1, wherein said means for selectively exerting and releasing comprises a swivel iron on which is mounted a rotatable closing element, said swivel iron and said closing element being moveable to a closed position in which closing element is configured to exert an at least partially rearwardly directed force on said boot and maintain said hook and strap in an interlocked state while permitting the heel of said boot to be raised.

3. The ski binding system of claim 1, wherein said at least one hook and strap comprises two hooks comprising static members rigidly fixed to said boot near opposing side edges of said sole.

4. The ski binding system of claim 3, wherein said two hooks are located in recesses formed in said sole.

5. The ski binding system of claim 1, wherein said at least one hook and strap comprises two straps comprising static members rigidly fixed to said boot near opposing side edges of said sole.

6. The ski binding system of claim 5, wherein said two straps are located in recesses formed in said sole.

7. A ski binding system, comprising:

a boot having a forefoot portion, a heel portion and a sole with a tread on the underside of said sole;

a binding fixedly attached to a ski; and at least one interlockable hook and strap for connecting said boot to said-binding, one of said hook and strap comprising a static member rigidly fixed to said binding, the other of said hook and strap comprising a static member rigidly fixed to said boot near a side edge of said sole within said forefoot portion, said other of said hook and strap positioned with its fill extent accommodated within said sole such that said other of said hook and strap does not extend beyond the tread of said sole;

wherein said binding further comprises a swivel iron on which is mounted a rotatable closing element, said swivel iron and said closing element being moveable to a closed position in which closing element is configured to exert an at least partially rearwardly directed force on said boot and maintain said hook and ad strap in an interlocked state while permitting the heel of said boot to be raised.

8. The ski binding system of claim 7, wherein said at least one hook and strap comprises two hooks comprising static members rigidly fixed to said boot near opposing side edges of said sole.

9. The ski binding system of claim 8, wherein said two hooks are located in recesses formed in said sole.

10. The ski binding system of claim 7, wherein said at least one hook and strap comprises two straps comprising static members rigidly fixed to said boot near opposing side edges of said sole.

11. The ski binding system of claim 10, wherein said two straps are located in recesses formed in said sole.

* * * * *

UNITED STATES PATENT AND TRADEMARK OFFICE

CERTIFICATE OF CORRECTION

PATENT NO. : 6,644,683 B1
DATED : November 11, 2003
INVENTOR(S) : Bernt-Otto Hauglin et al.

It is certified that error appears in the above-identified patent and that said Letters Patent is hereby corrected as shown below:

Column 7,
Line 16, please replace “fill” with -- full --.

Signed and Sealed this

Eighteenth Day of May, 2004

JON W. DUDAS
*Acting Director of the United States Patent and Trademark Office*